US011020997B2

(12) United States Patent
Kudo

(10) Patent No.: US 11,020,997 B2
(45) Date of Patent: Jun. 1, 2021

(54) PRINTING APPARATUS, CONTROL METHOD, AND STORAGE MEDIUM

(71) Applicant: CANON KABUSHIKI KAISHA, Tokyo (JP)

(72) Inventor: Naotoshi Kudo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/297,446

(22) Filed: Mar. 8, 2019

(65) Prior Publication Data

US 2019/0283475 A1 Sep. 19, 2019

(30) Foreign Application Priority Data

Mar. 13, 2018 (JP) ..... JP2018-046013

(51) Int. Cl.

| | |
|---|---|
| ***B41J 29/38*** | (2006.01) |
| ***B41J 29/58*** | (2006.01) |
| ***B41J 2/175*** | (2006.01) |
| ***B41J 3/46*** | (2006.01) |
| ***B41J 29/13*** | (2006.01) |
| ***B41J 2/185*** | (2006.01) |

(52) U.S. Cl.

CPC ..... *B41J 29/58* (2013.01); *B41J 2/1752* (2013.01); *B41J 2/17596* (2013.01); *B41J 2/185* (2013.01); *B41J 3/46* (2013.01); *B41J 29/13* (2013.01); *B41J 29/38* (2013.01)

(58) Field of Classification Search

CPC ..... B41J 2/1752; B41J 25/34; B41J 29/202
See application file for complete search history.

(56) References Cited

U.S. PATENT DOCUMENTS

| | | | | |
|---|---|---|---|---|
| 6,450,610 | B1 * | 9/2002 | Shimura | B41J 25/34 347/108 |
| 8,777,402 | B2 * | 7/2014 | Koichi | B41J 19/202 347/108 |
| 2008/0068787 | A1 | 3/2008 | Okada | |
| 2010/0329704 | A1 * | 12/2010 | Tachibana | G03G 15/0855 399/27 |
| 2018/0004148 | A1 | 1/2018 | Kanno | |

FOREIGN PATENT DOCUMENTS

| | | | |
|---|---|---|---|
| JP | H11-217152 | A | 8/1999 |
| JP | 03619654 | B2 | 2/2005 |
| JP | 2006-44128 | A | 2/2006 |
| JP | 2007-083504 | A | 4/2007 |
| JP | 2008-162158 | A | 7/2008 |
| JP | 04851280 | B2 | 1/2012 |
| JP | 2018004823 | A | 1/2018 |

* cited by examiner

*Primary Examiner* — Lam S Nguyen
(74) *Attorney, Agent, or Firm* — Canon U.S.A., Inc. IP Division

(57) ABSTRACT

A printing apparatus includes a detection unit configured to detect that a predetermined user operation for unlocking an opening and closing portion is made on a predetermined screen displayed on a display portion in a state where the opening and closing portion is locked, an unlock unit configured to, in a case where the predetermined user operation is detected to be made, unlock the opening and closing portion, and an execution unit configured to, in a case where the predetermined user operation is detected to be made, execute predetermined preparation processing on a printing portion.

18 Claims, 17 Drawing Sheets

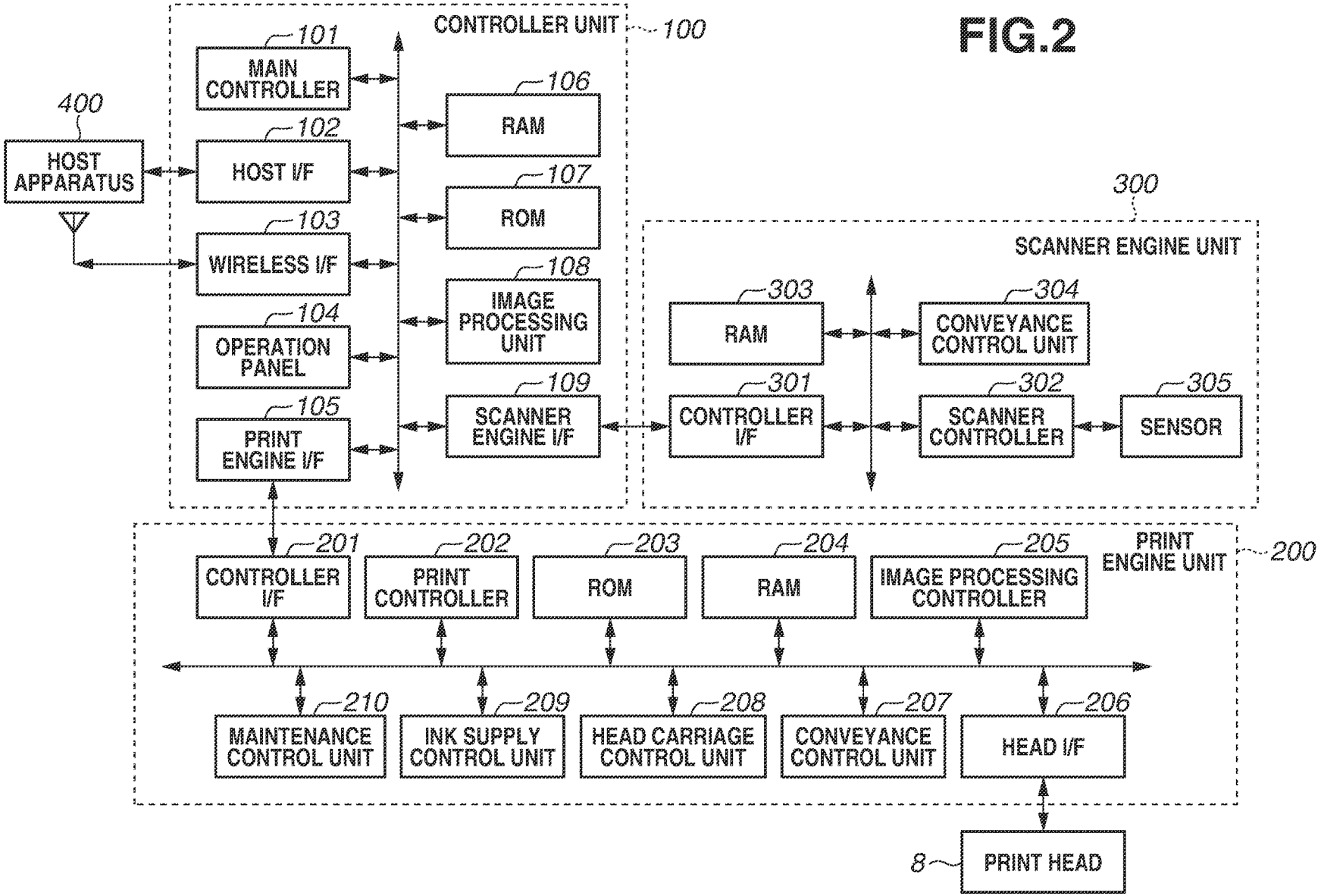
FIG.2
100
CONTROLLER UNIT
101
MAIN CONTROLLER
102
HOST I/F
103
WIRELESS I/F
104
OPERATION PANEL
105
PRINT ENGINE I/F
106
RAM
107
ROM
108
IMAGE PROCESSING UNIT
109
SCANNER ENGINE I/F
400
HOST APPARATUS
300
SCANNER ENGINE UNIT
301
CONTROLLER I/F
302
SCANNER CONTROLLER
303
RAM
304
CONVEYANCE CONTROL UNIT
305
SENSOR
200
PRINT ENGINE UNIT
201
CONTROLLER I/F
202
PRINT CONTROLLER
203
ROM
204
RAM
205
IMAGE PROCESSING CONTROLLER
206
HEAD I/F
207
CONVEYANCE CONTROL UNIT
208
HEAD CARRIAGE CONTROL UNIT
209
INK SUPPLY CONTROL UNIT
210
MAINTENANCE CONTROL UNIT
8
PRINT HEAD

PRINTING APPARATUS, CONTROL METHOD, AND STORAGE MEDIUM

BACKGROUND OF THE INVENTION

Field of the Invention

The present invention relates to a printing apparatus, a control method, and a storage medium.

Description of the Related Art

A printing apparatus that includes an openable portion, such as a door, forming a part of a casing enclosing a print unit (portion), wherein the openable unit is able to be locked and unlocked is known. Japanese Patent Application Laid-Open No. 2006-44128 discusses an apparatus that locks an opening and closing unit while an image forming operation is performed, and unlocks the opening and closing unit after the end of the image forming operation.

In a case where the opening and closing unit is to be unlocked, a predetermined preparation operation can be performed on the print unit in preparation for situations where a user opens the opening and closing unit to make user operations on the print unit. However, if the apparatus discussed in Japanese Patent Application Laid-Open No. 2006-44128 is configured to perform the preparation operation in response to the unlocking of the opening and closing unit, a maintenance operation is performed each time an image forming operation ends. The user, however, does not necessarily open the opening and closing unit each time an image forming operation ends. In other words, the preparation operation is performed even when the user does not open the opening and closing unit.

SUMMARY OF THE INVENTION

The present invention is directed to suppressing execution of the preparation operation even when the user does not open the opening and closing unit.

According to an aspect of the present invention, a printing apparatus includes a printing unit configured to perform printing by a printing portion, a lock unit configured to lock an openable portion formed as part of a casing enclosing the printing portion, a display unit configured to display, on a display portion, a predetermined screen based on an occurrence of an error in at least part of the printing portion, a detection unit configured to detect that a predetermined user operation for unlocking the openable portion is performed on the predetermined screen in a state where the openable portion is locked, an execution unit configured, in a case where the predetermined user operation has been detected, to execute predetermined preparation processing on the printing portion and, an unlock unit configured, in a case where the predetermined user operation performed on the predetermined screen has been detected, to unlock the openable portion after the predetermined preparation processing is executed, wherein, even when a user operation for opening the openable portion is executed on the openable portion in the state where the openable portion is locked, the openable portion is not opened and the predetermined preparation processing is not executed.

Further features of the present invention will become apparent from the following description of exemplary embodiments with reference to the attached drawings. Each of the embodiments of the present invention described below can be implemented solely or as a combination of a plurality of the embodiments. Also, features from different embodiments can be combined where necessary or where the combination of elements or features from individual embodiments in a single embodiment is beneficial.

BRIEF DESCRIPTION OF THE DRAWINGS

FIG. 2 is a control configuration diagram of the printing apparatus.

DESCRIPTION OF THE EMBODIMENTS

A printing apparatus according to a first exemplary embodiment will be described. In the present exemplary embodiment, an apparatus that performs inkjet printing is described as an example of the printing apparatus. However, this is not restrictive. The present exemplary embodiment is also applicable to apparatuses that perform processing by printing methods other than inkjet printing (such as an electrophotographic method and a thermal sublimation method).

Figure 1:
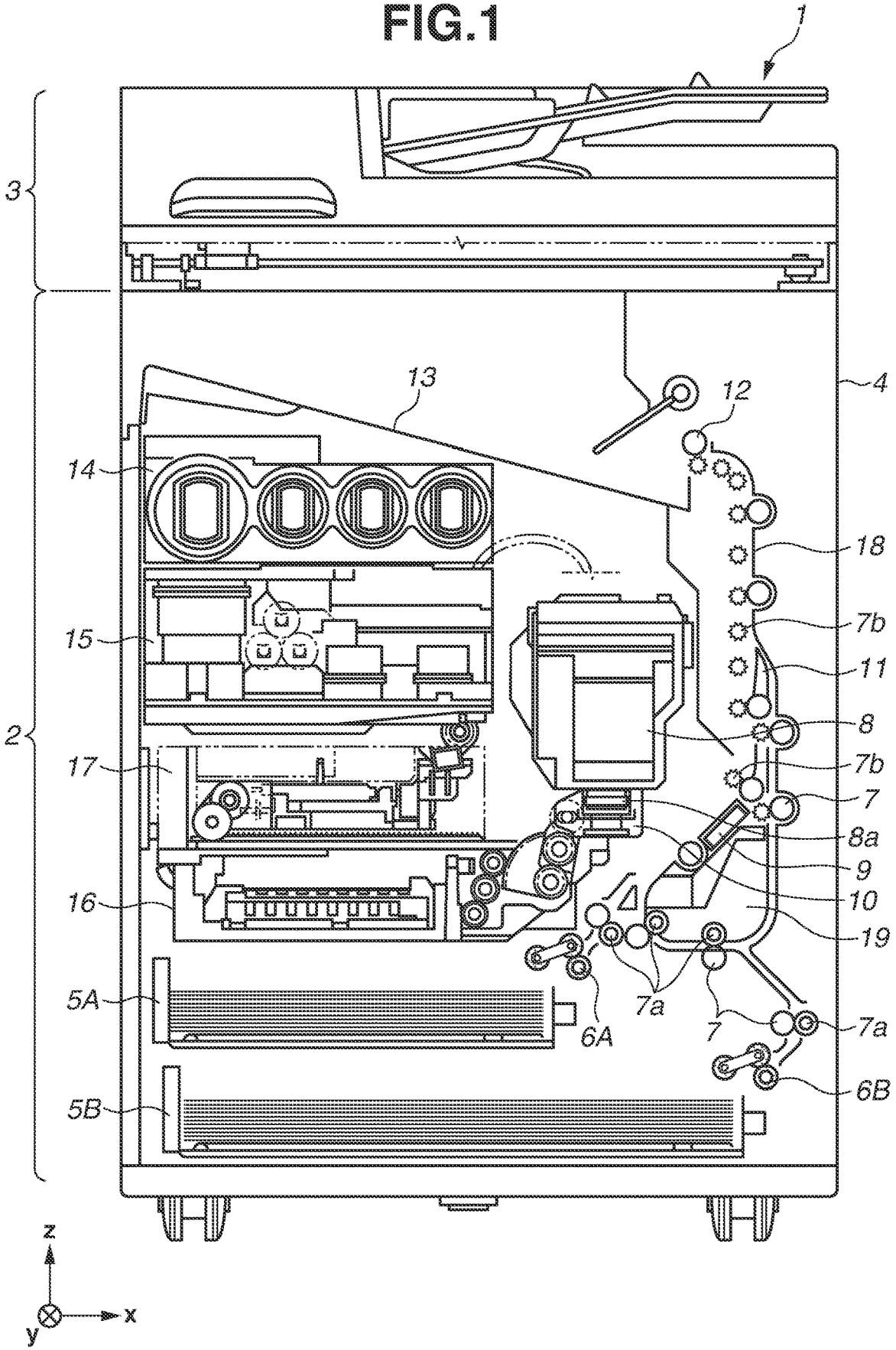
FIG. 1 is an internal configuration diagram of a printing apparatus when the printing apparatus is in a standby state.

FIG. 1 is an internal configuration diagram of an inkjet printing apparatus 1 (hereinafter, printing apparatus 1) used in the present exemplary embodiment. An inkjet printing apparatus refers to an apparatus that forms an image on a recording medium, such as paper, by discharging ink serving as a recording agent. In the diagram, an x-direction represents a horizontal direction, a y-direction (perpendicular direction) a direction in which discharge ports are arranged on a print head 8 to be described below, and a z-direction a vertical direction.

The printing apparatus 1 is a multifunction peripheral including a print unit 2 and a scanner unit 3. The printing apparatus 1 can perform various types of processing related to a print operation and a read operation by using the print unit 2 and the scanner unit 3 singly or cooperatively. The scanner unit 3 includes an auto document feeder (ADF) and a flatbed scanner (FBS). The scanner unit 3 can read documents automatically fed by the ADF, and can read (scan) a document placed on a document table of the FBS by the user. While the present exemplary embodiment deals with the multifunction peripheral including the print unit 2 and the scanner unit 3, the printing apparatus 1 may be configured to not include the scanner unit 3. FIG. 1 illustrates the printing apparatus 1 in a standby state in which neither the print operation nor the read operation is performed.

The print unit 2 includes a first cassette 5A and a second cassette 5B for storing recording media (cut sheets) S. The first and second cassettes 5A and 5B are detachably installed in a bottom portion of a casing 4 vertically below. Relatively small recording media up to A4 size are stacked flat and stored in the first cassette 5A. Relatively large recording media up to A3 size are stacked flat and stored in the second cassette 5B. A first feed unit 6A for separating and feeding the stored recording media one by one is provided near the first cassette 5A. Similarly, a second feed unit 6B is provided near the second cassette 5B. When a print operation is performed, recording media S are selectively fed from either one of the cassettes 5A and 5B.

Conveyance rollers 7, a discharge roller 12, pinch rollers 7*a*, spurs 7*b*, a guide 18, an inner guide 19, and a flapper 11 are conveyance mechanisms for guiding a recording medium S in a predetermined direction. The conveyance rollers 7 are driving rollers that are arranged upstream of a print head 8 and driven by a not-illustrated conveyance motor. The pinch rollers 7*a* are driven rollers that nip the recording medium S and rotate with the conveyance rollers 7. The discharge roller 12 is a driving roller that is arranged downstream of the print head 8 and driven by a not-illustrated conveyance motor. The spurs 7*b* pinch and convey the recording medium S with the discharge roller 12.

The guide 18 is provided on a conveyance path of the recording medium S and guides the recording medium S in a predetermined direction. The inner guide 19 is a member extending in the y-direction. The inner guide 19 has a curved side surface and guides the recording medium S along the side surface. The flapper 11 is a member for switching a direction in which the recording medium S is conveyed during a two-sided print operation. A discharge tray 13 is a tray for stacking and holding recording media S discharged by the discharge roller 12 after completion of a print operation.

The print head 8 according to the present exemplary embodiment is a full-line color inkjet print head, and has a plurality of discharge ports for discharging ink based on print data. The discharge ports are arranged as many as to cover the width of the recording medium S in the y-direction in FIG. 1. When the print head 8 is at a standby position, a discharge port surface 8*a* of the print head 8 is capped by a cap unit 10 as illustrated in FIG. 1. When performing a print operation, the print head 8 is changed in orientation by a print controller 202 to be described below so that the discharge port surface 8*a* faces a platen 9. The platen 9 includes a flat plate extending in the y-direction, and supports from behind the recording medium S on which the print head 8 performs a print operation. The movement of the print head 8 from the standby position to the printing position will be described in detail below.

An ink tank unit (holding unit) 14 stores four color inks to be supplied to the print head 8. An ink supply unit 15 is provided in the flow channels from the ink tank unit 14 to the print head 8, and adjusts the pressures and flow rates of the inks in the print head 8 to appropriate ranges. The present exemplary embodiment employs an ink supply system of a circulation type. The ink supply unit 15 adjusts the pressures of the inks supplied to the print head 8 and the flow rates of the inks collected from the print head 8 to appropriate ranges.

A maintenance unit 16 includes the cap unit 10 and a wiping unit 17, and activates these units at predetermined timing to perform a maintenance operation on the print head 8. The maintenance operation will be described in detail below.

The maintenance unit 16 includes a user-replaceable maintenance cartridge (MTC) (collection unit) 20. The MTC 20 collects and stores waste ink unused for printing out of the ink stored in the ink tanks.

FIG. 2 is a block diagram illustrating a control configuration in the printing apparatus 1. The control configuration includes a print engine unit 200 that mainly controls the print unit 2, a scanner engine unit 300 that controls the scanner unit 3, and a controller unit 100 that controls the entire printing apparatus 1. A print controller 202 controls various mechanisms of the print engine unit 200 based on instructions from a main controller 101 of the controller unit 100. Various mechanisms of the scanner engine unit 300 are controlled by the main controller 101 of the controller unit 100. Details of the control configuration are described below.

In the controller unit 100, the main controller 101 including a central processing unit (CPU) controls the entire printing apparatus 1 in accordance with programs and various parameters stored in a read-only memory (ROM) 107 by using a random access memory (RAM) 106 as a work area. For example, if a print job is input from a host apparatus 400 via a host interface (I/F) 102 or a wireless I/F 103, an image processing unit 108 applies predetermined image processing to received image data based on instructions from the main controller 101. The main controller 101 transmits the image data to which the image processing is applied to the print engine unit 200 via a print engine I/F 105.

The printing apparatus 1 may obtain image data from the host apparatus 400 via wireless or wired communication. The printing apparatus 1 may obtain image data from an external storage device (such as a Universal Serial Bus (USB) memory) connected to the printing apparatus 1. The communication method used for the wireless or wired communication is not limited in particular. Examples of communication methods usable for the wireless communication include Wireless Fidelity (Wi-Fi®) and Bluetooth®. Communication methods used for the wired communication may include USB. For example, if a read command is input from the host apparatus 400, the main controller 101 transmits the command to the scanner unit 3 via a scanner engine I/F 109.

An operation panel (display unit) 104 is a mechanism for the user to make inputs and outputs to/from the printing apparatus 1. The user can give instructions for copy and scan operations, set a print mode, and recognize information about the printing apparatus 1 via the operation panel 104.

In the print engine unit 200, the print controller 202 including a CPU controls various mechanisms included in the print unit 2 in accordance with programs and various parameters stored in a ROM 203 by using a RAM 204 as a work area. If various commands or image data is received via a controller I/F 201, the print controller 202 once stores the commands or image data into the RAM 204. The print controller 202 makes an image processing controller 205 convert the stored image data into print data so that the print head 8 can use the print data for a print operation. When print data is generated, the print controller 202 makes the print head 8 perform a print operation based on the print data via a head I/F 206. At this time, the print controller 202 drives the feed unit 6A or 6B, the conveyance rollers 7, the discharge roller 12, and the flapper 11 illustrated in FIG. 1 via a conveyance control unit 207 to convey a recording medium S. The print head 8 performs a print operation in conjunction with the conveyance operation of the recording medium S based on instructions from the print controller 202, whereby print processing is performed.

A head carriage control unit 208 changes the orientation and position of the print head 8 according to operation states of the printing apparatus 1, such as a maintenance state and a printing state. An ink supply control unit 209 controls the ink supply unit 15 so that the pressures of the inks supplied to the print head 8 fall within an appropriate range. A maintenance control unit 210 controls operation of the cap unit 10 and the wiping unit 17 in the maintenance unit 16 when performing a maintenance operation on the print head 8.

As for the scanner engine unit 300, the main controller 101 controls hardware resources of the scanner controller 302 in accordance with programs and various parameters stored in the ROM 107 by using the RAM 106 as a work area. Various mechanisms included in the scanner unit 3 are thereby controlled. For example, the main controller 101 controls the hardware resources in the scanner controller 302 via a controller I/F 301, whereby a document placed on the ADF by the user is conveyed via a conveyance control unit 304. The main controller 101 then reads the conveyed document by using a sensor 305. The scanner controller 302 stores the read image data into a RAM 303. By converting the obtained image data into print data as described above, the print controller 202 can make the print head 8 perform a print operation based on the image data read by the scanner controller 302.

Figure 3:
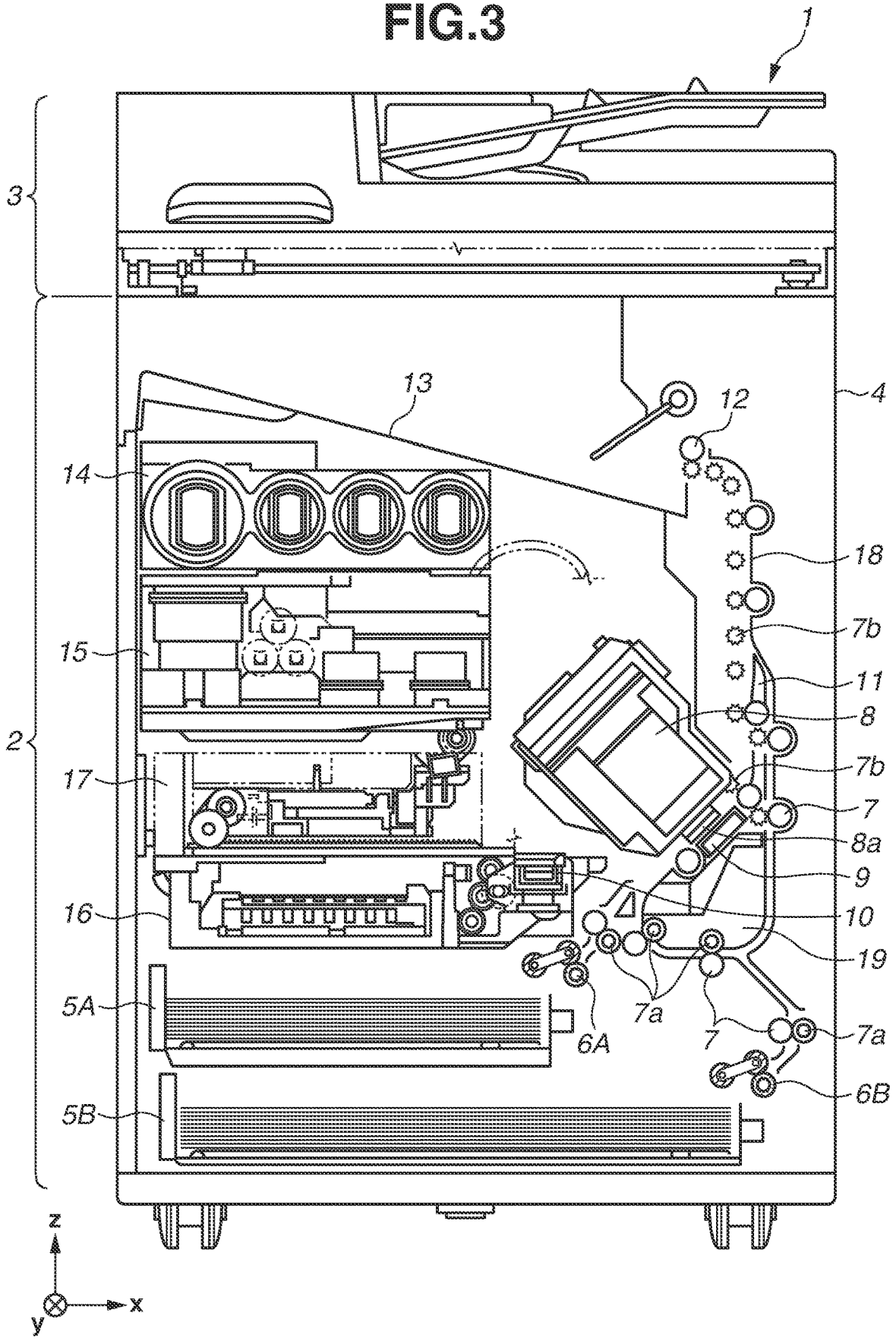
FIG. 3 is an internal configuration diagram of the printing apparatus when the printing apparatus is in a printing state.

FIG. 3 illustrates an internal configuration diagram of the printing apparatus 1 when the printing apparatus 1 is in a printing state. Compared to the standby state illustrated in FIG. 1, the cap unit 10 is separated from the discharge port surface 8*a* of the print head 8, and the discharge port surface 8*a* is opposed to the platen 9. In the present exemplary embodiment, the plane of the platen 9 is tilted approximately 45° from the horizontal direction. The discharge port surface 8*a* of the print head 8 at the printing position is also tilted approximately 45° from the horizontal direction so that the discharge port surface 8*a* is maintained at a constant distance from the platen 9.

When moving the print head 8 from the standby position illustrated in FIG. 1 to the printing position illustrated in FIG. 3, the print controller 202 lowers the cap unit 10 to a retracted position illustrated in FIG. 3 by using the maintenance control unit 210. The discharge port surface 8*a* of the print head 8 is thereby separated from a cap member included in the cap unit 10. The print controller 202 then rotates the print head 8 by 45° while adjusting the vertical height of the print head 8 by using the head carriage control unit 208, so that the discharge port surface 8*a* faces the platen 9. When the print operation is completed and the print head 8 moves from the printing position to the standby position, the print controller 202 performs the steps reverse to the foregoing.

Next, a path by which the print unit 2 conveys a recording medium S will be described. When a print command (print job) is input, the print controller 202 initially moves the print head 8 to the printing position illustrated in FIG. 3 by using the maintenance control unit 210 and the head carriage control unit 208. The print controller 202 then drives either one of the first and second feed units 6A and 6B to feed a recording medium S based on the print command by using the conveyance control unit 207.

Figure 4C:
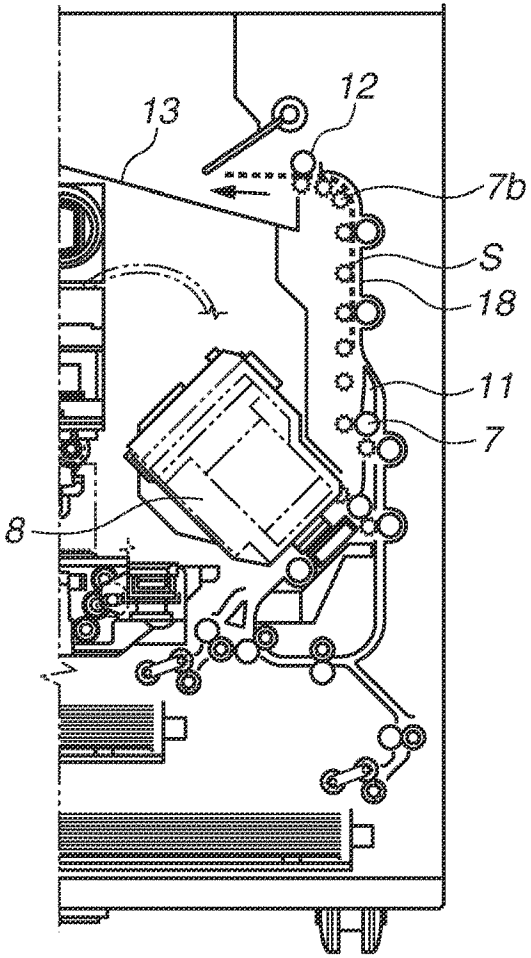
FIGS. 4A to 4C are conveyance path diagrams of a recording medium fed from a first cassette.
Figure 4B:
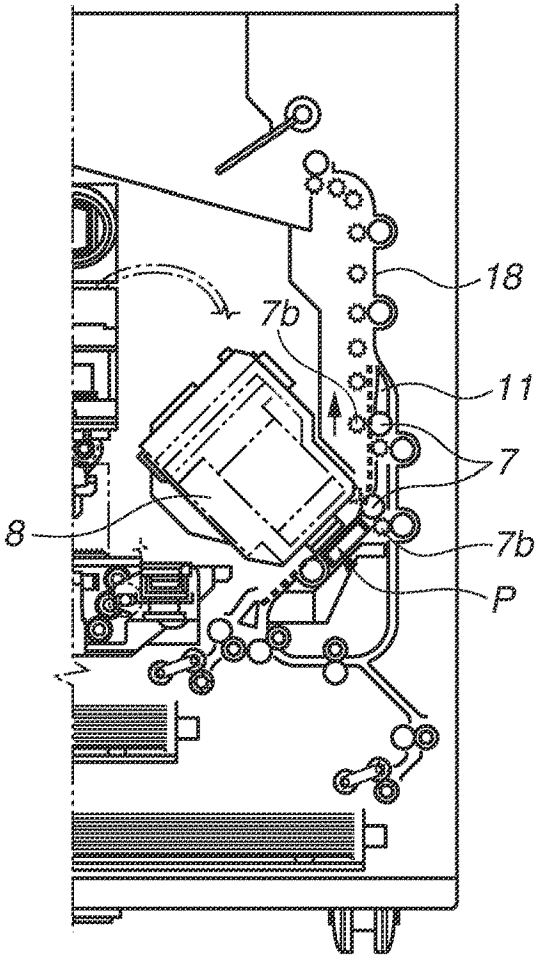
Figure 4A:
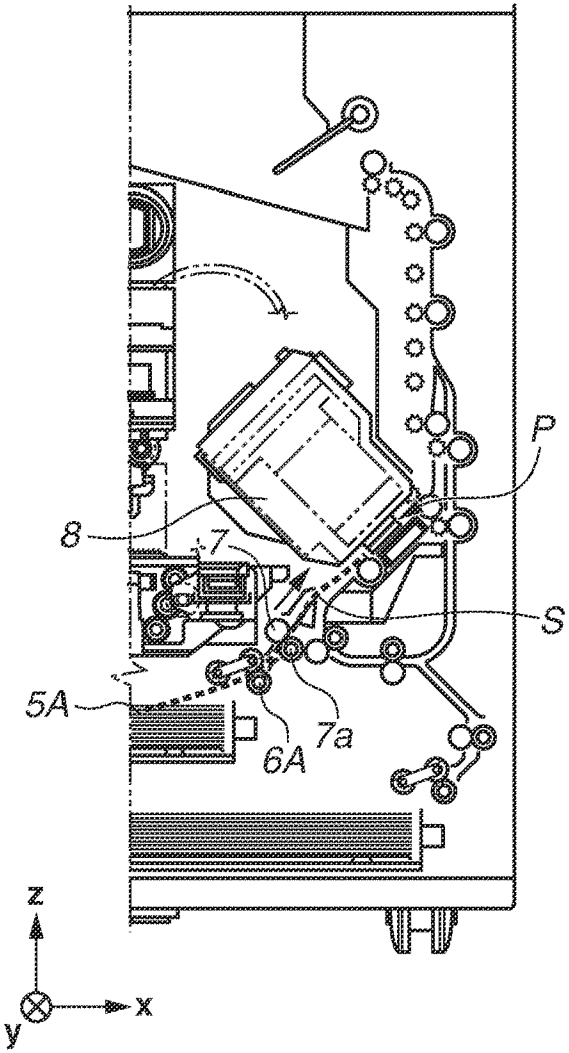

FIGS. 4A to 4C are diagrams illustrating a conveyance path in feeding an A4-size recording medium S stored in the first cassette 5A. The uppermost one of the recording media S stacked in the first cassette 5A is separated from the second and subsequent recording media S by the first feed unit 6A, and conveyed toward a printing area P between the platen 9 and the print head 8 while being nipped by the conveyance rollers 7 and the pinch rollers 7*a*. FIG. 4A illustrates a conveyance state immediately before the leading edge of the recording medium S reaches the printing area P. The traveling direction of the recording medium S is changed from the horizontal direction (x-direction) to a direction approximately 45° tilted from the horizontal direction while being fed by the first feed unit 6A to reach the printing area P.

In the printing area P, ink is discharged from the plurality of discharge ports provided in the print head 8 to the recording medium S. The area of the recording medium S in which the ink is to be applied to is supported by the platen 9 from behind, and the distance between the discharge port surface 8*a* and the recording medium S is maintained constant. The ink-applied recording medium S is guided by the conveyance rollers 7 and the spurs 7*b* while the leading edge passes the left side of the flapper 11 tilted to the right, and conveyed vertically upward in the printing apparatus 1 along the guide 18. FIG. 4B illustrates a state where the leading edge of the recording medium S passes the printing area P and is conveyed vertically upward. The travelling direction of the recording medium S is changed to vertically upward by the conveyance rollers 7 and the spurs 7*b* at the position of the printing area P approximately 45° tilted from the horizontal direction.

After being conveyed vertically upward, the recording medium S is discharged to the discharge tray 13 by the discharge roller 12 and the spurs 7*b*. FIG. 4C illustrates a state where the leading edge of the recording medium S passes the discharge roller 12 and is discharged to the discharge tray 13. The discharged recording medium S is held on the discharge tray 13 with the surface on which an image is printed by the print head 8 down.

Next, the maintenance operation on the print head 8 will be described. As described in FIG. 1, the maintenance unit 16 according to the present exemplary embodiment includes the cap unit 10 and the wiping unit 17, and activates these units at predetermined timing to perform the maintenance operation.

Figure 5:
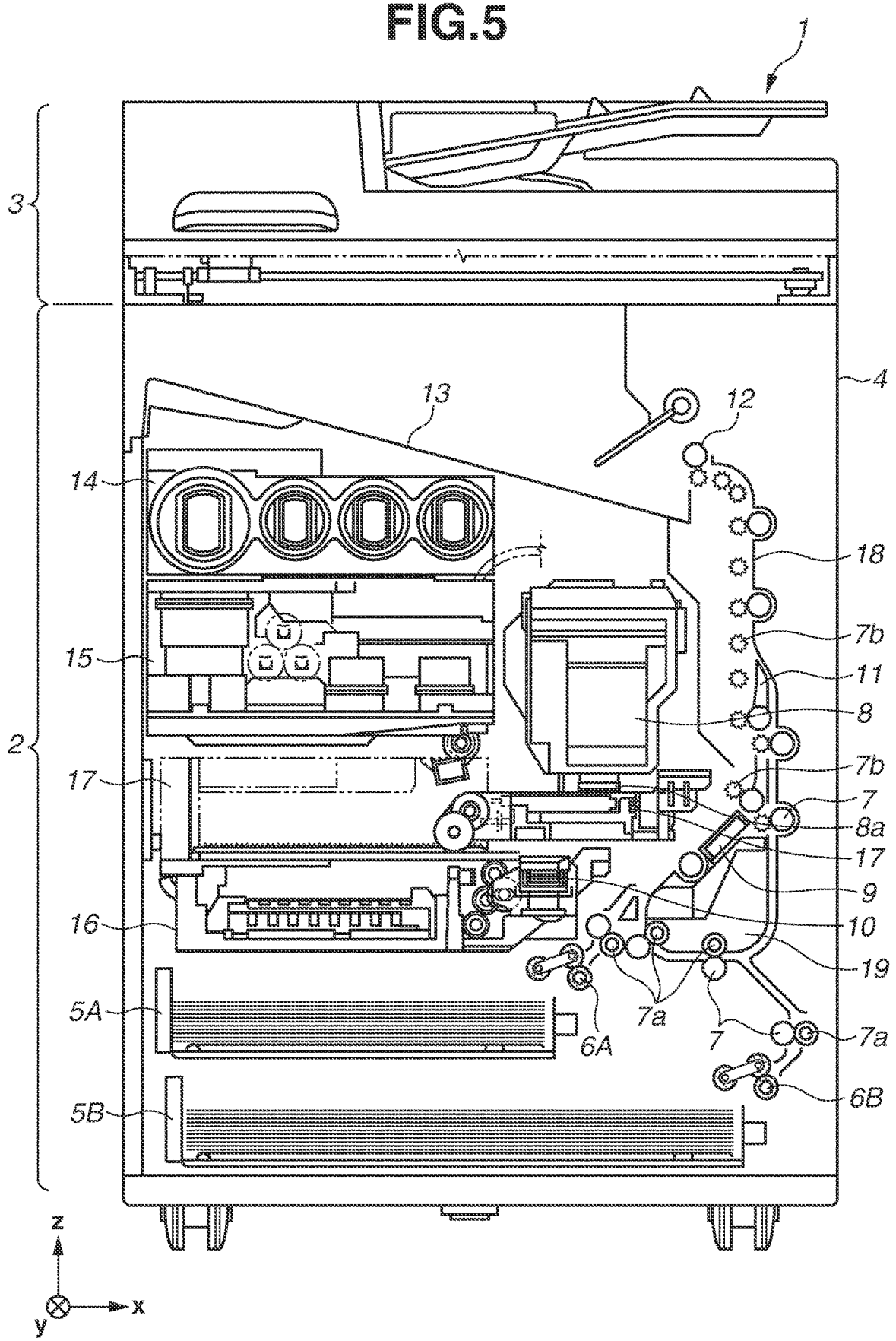
FIG. 5 is an internal configuration diagram of the printing apparatus when the printing apparatus is in a maintenance state.

FIG. 5 is an internal configuration diagram of the printing apparatus 1 when the printing apparatus 1 is in a maintenance state. When moving the print head 8 from the standby position illustrated in FIG. 1 to a maintenance position illustrated in FIG. 5, the print controller 202 moves the print head 8 obliquely vertically upward and moves the cap unit 10 vertically downward. The print controller 202 then moves the wiping unit 17 from the retracted position to the right in FIG. 5. The print controller 202 then moves the print head 8 vertically downward to the maintenance position capable of a maintenance operation.

When moving the print head 8 from the printing position illustrated in FIG. 3 to the maintenance position illustrated in FIG. 5, the print controller 202 moves the print head 8 vertically upward while rotating the print head 8 by 45°. The print controller 202 then moves the wiping unit 17 from the retracted position to the right. The print controller 202 then moves the print head 8 vertically downward into the maintenance position capable of a maintenance operation by the maintenance unit 16.

With the print head 8 moved to the maintenance position, the cap unit 10 collects ink discharged by a preliminary discharge into the not-illustrated cap member, and causes a not-illustrated suction pump to suck in the collected ink. The wiping unit 17 wipes adhering ink off the discharge port surface 8*a*. The maintenance operation is performed by such suction processing and wiping processing.

<Lock Control on Front Door 22>

Figure 17:
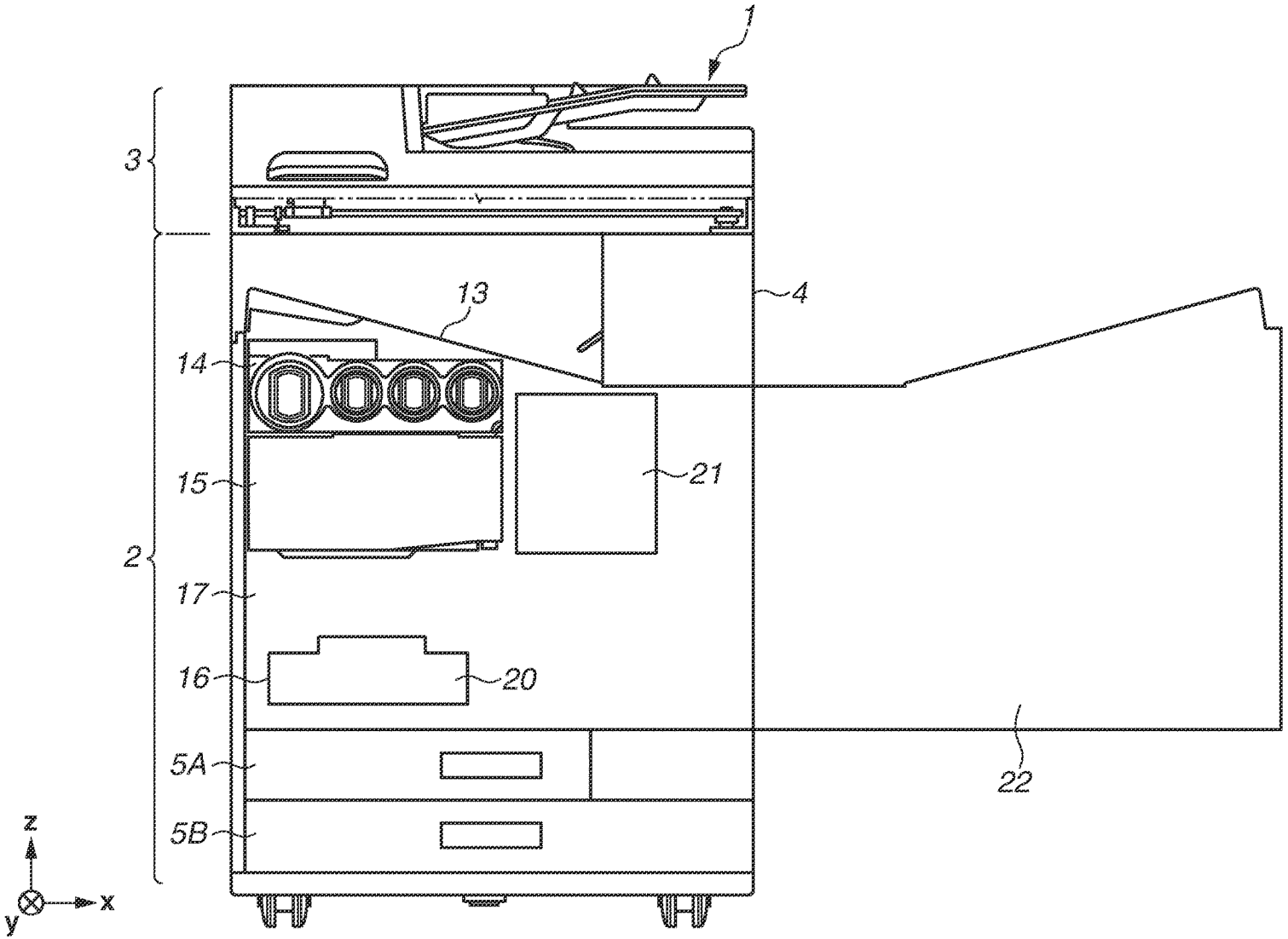
FIG. 17 is a diagram illustrating an appearance of the printing apparatus in a state where the front door is located at an open position.

The interior components of the print unit 2 illustrated in FIGS. 1, 3, and 17 are covered by an exterior member (casing 4 of the printing apparatus 1). The exterior member includes a front door 22 that is rotatable (openable) between an open position at which an opening is uncovered and a closed position at which the opening is covered. FIG. 17 is a diagram illustrating an appearance of the printing apparatus 1 in a state where the front door 22 is located at the open position. If the front door 22 is located at the open position, the user can access the interior members of the print unit 2, including the color ink tanks loaded in the ink tank unit 14, the MTC 20, and the print head 8, through the opening. In other words, the user can do maintenance, such as replacement, repair, and cleaning of the interior members of the print unit 2, through the opening.

In the present exemplary embodiment, the front door 22 is locked in an unopenable state (not movable from the closed position) until an unlock button to be described below is operated by the user. To open the front door 22, the user needs to operate the unlock button to be described below to unlock the front door 22. If the front door 22 is opened and returned to the closed position, the front door 22 enters the locked state again.

A program for implementing one or more functions of the printing apparatus 1 or the host apparatus 400 according to the present exemplary embodiment may be supplied to a system or an apparatus via a network or various storage media. Then, a computer (such as a CPU and a microprocessing unit (MPU)) of the system or apparatus may read the program and perform the function(s) or cause various mechanisms to perform the function(s). The program may be executed by one computer or by a plurality of computers in a cooperative manner. All the foregoing processing does not need to be implemented by software, and part or all of the processing may be implemented by hardware such as an application specific integrated circuit (ASIC). All the processing does not necessarily be performed by a single CPU. A plurality of CPUs may perform the processing with appropriate cooperation. Some of the processing may be performed by one CPU while the rest of the processing is performed by a plurality of CPUs in a cooperative manner.

As described above, in the present exemplary embodiment, if the front door 22 is located at the open position, the user can operate the interior components of the print unit 2 and do maintenance, such as replacement, repair, and cleaning of the interior components, by, for example, putting his/her hands in the opening. Such interior components are desirably prevented from user operations while the interior components are working, like during printing and during maintenance. The front door 22 is thus desirably locked to be not opened at least while the interior components are working.

Before the interior components of the print unit 2 are replaced, preparation processing to be described below is desirably executed. However, if, for example, the front door 22 is not configured to be constantly locked, the interior components of the print unit 2 can be replaced without the preparation processing. The front door 22 is therefore desirably locked until a preparation operation is performed. Suppose, for example, that the front door 22 is configured to be automatically unlocked and execute the preparation processing at timing when the maintenance processing on the interior components needs to be performed. With such a configuration, the preparation processing can be executed even when the user does not perform the maintenance processing at that timing. In other words, the preparation processing can be executed needlessly. The preparation processing includes writing processing on a nonvolatile memory. If the nonvolatile memory has a limited number of writes (nonvolatile memory has a writing life), the needless execution of the preparation processing reduces the life of the nonvolatile memory in vain.

In the present exemplary embodiment, the front door 22 is configured to be locked. The front door 22 is configured to not be automatically unlocked without a user operation. The front door 22 is unlocked and becomes openable in response to the printing apparatus 1 determining that a user operation for opening the front door 22 is made on the printing apparatus 1. In other words, the printing apparatus 1 is configured so that the printing apparatus 1 can identify the timing when the user does maintenance of the interior components of the print unit 2 via the opening by determining that the user operation is made.

While the openable component (opening and closing unit) to be locked and unlocked is described to be the front door 22, such a configuration is not restrictive. For example, the openable component to be locked and unlocked may be a tray or a drawer that can be pulled out of the printing apparatus 1. In such a case, the state where the component is pulled out of the printing apparatus 1 corresponds to the state where the component is located at the open position. The state where the component is pushed into the printing apparatus 1 corresponds to the state where the component is located at the closed position.

Figure 6A:
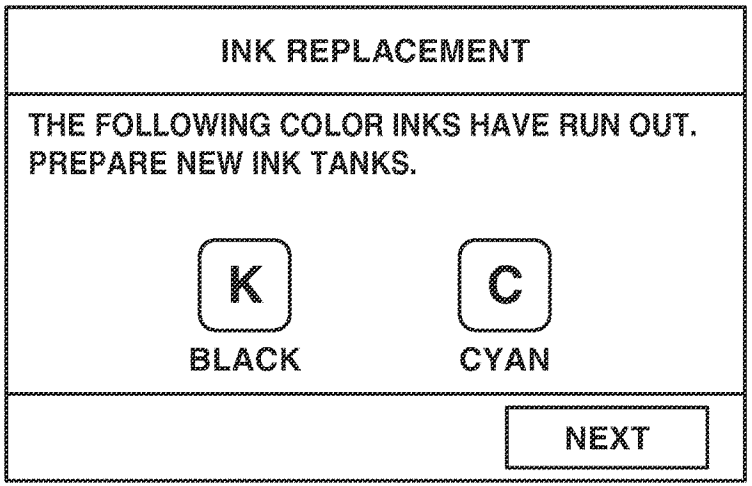
FIGS. 6A to 6D illustrate examples of screens displayed on an operation panel.

FIGS. 6A to 6D illustrate examples of screens displayed on the operation panel 104. FIG. 6A illustrates an example of a screen for notifying the user of the occurrence of an out-of-ink error that is an error due to running out of ink in the printing apparatus 1. The printing apparatus 1 suspends a print operation or maintenance operation and displays the screen illustrated in FIG. 6A on the operation panel 104 in response to the occurrence of an out-of-ink error due to running out of ink in the print operation or maintenance operation. The screen illustrated in FIG. 6A is an example of a screen for notifying the user of the occurrence of an error due to running out of black ink and cyan ink. If the user presses the "next" button on the screen of FIG. 6A, the printing apparatus 1 displays an unlock screen illustrated in FIG. 6B on the operation panel 104.

The unlock screen is a screen for accepting a user operation (unlock operation) for opening the front door 22. The unlock screen is displayed here because the user needs to open the front door 22 (move the front door 22 to the open position) to replace an ink tank or ink tanks.

Figure 6B:
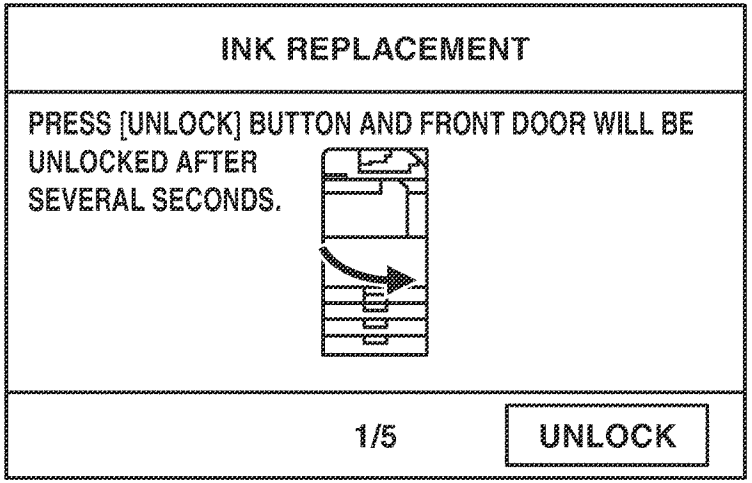

If an "unlock" button on the screen of FIG. 6B is pressed by the user, the printing apparatus 1 initially performs ink replacement preparation processing (ink replacement preparation operation) before the front door 22 is unlocked and before the ink tanks are replaced. The ink replacement preparation processing includes processing for writing information related to the ink tanks, such as information about the remaining ink levels, to nonvolatile memory areas of the ink tanks. The ink replacement preparation processing also includes processing for closing supply valves (not illustrated) for supplying ink from the ink tanks so that air will not get into ink supply channels when the ink tanks are detached.

When the front door 22 is opened, not only the ink tanks but also the MTC can be replaced. If the ink replacement preparation processing is executed, MTC replacement preparation processing is therefore also executed. For example, the MTC replacement preparation processing includes writing information related to the MTC, such as information about the amount of ink included in the MTC, into a nonvolatile memory area. If the "unlock" button on the screen of FIG. 6B is pressed, head replacement preparation processing to be described below is not executed. The reason is that if the "unlock" button on the screen of FIG. 6B is pressed, the front door 22 is opened but a head cover covering the print head 8 is not opened. The print head 8 does not move to a head replacement position for replacing the print head 8, either.

In the present exemplary embodiment, the ink replacement preparation processing and the MTC replacement preparation processing are executed in response to the pressing of the "unlock" button on the screen of FIG. 6B. The front door 22 is unlocked after both the preparation operations end. The screen of FIG. 6B therefore includes an area for making a notification that the front door 22 will not be unlocked for a time needed for both the preparation operations. The timing and condition to start the preparation operations are not limited to the foregoing. For example, the preparation operations may be started in response to a "next" button on the screen of FIG. 6A being pressed by the user or in response to the occurrence of an out-of-ink error. Since FIG. 6B illustrates an unlock screen for replacing the ink tanks, an area indicating the replacement of the ink tanks is included in the upper part of the screen.

Figure 6C:
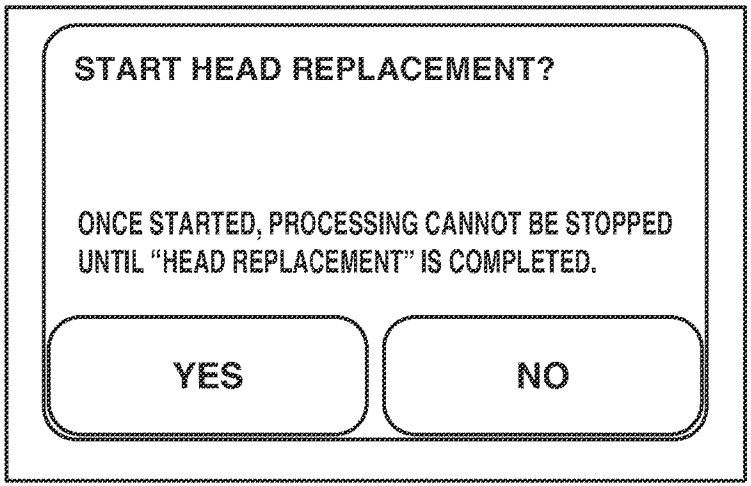

FIG. 6C illustrates an example of a screen for inquiring the user whether to perform processing for replacing the print head 8. The user can cause the screen of FIG. 6C to be displayed on the operation panel 104 by operating a setting screen of the printing apparatus 1 displayed on the operation panel 104 at arbitrary timing when the user wants to replace the print head 8. If the "no" button is pressed, the printing apparatus 1 restores the screen displayed on the operation panel 104 to the setting screen having been displayed before the display of the screen of FIG. 6C without executing the head replacement preparation processing or displaying an unlock screen illustrated in FIG. 6D. On the other hand, if the "yes" button is pressed, the printing apparatus 1 displays the unlock screen illustrated in FIG. 6D on the operation panel 104.

Figure 6D:
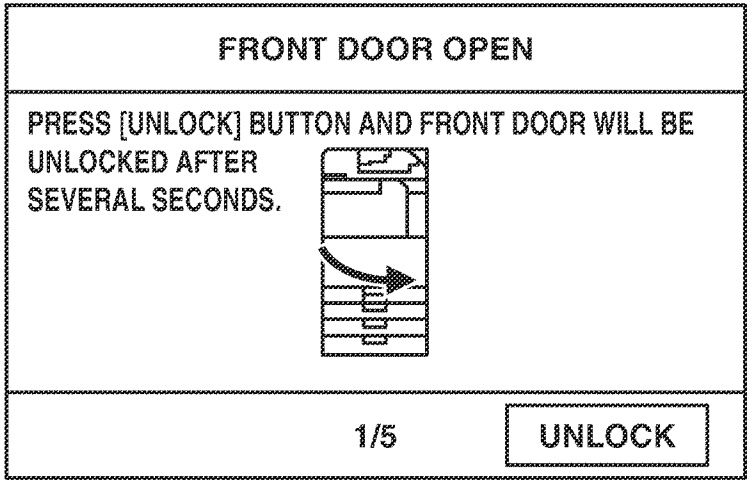

If the "unlock" button on the screen of FIG. 6D is pressed by the user, the printing apparatus 1 performs the head replacement preparation processing (head replacement preparation operation) before the front door 22 is unlocked and before the print head 8 is replaced. The head replacement preparation processing includes processing for collecting the ink remaining in the print head 8 into a sub tank and closing the ink valves for supplying ink to the print head 8 so that ink will not be supplied to the print head 8. The head replacement preparation processing also includes processing for writing information about a use history of nozzles arranged in the print head 8, a time at which the print head 8 is powered on, and an error occurring in the print head 8 into a nonvolatile memory area of the print head 8. The head replacement preparation processing also includes processing for opening the head cover that needs to be opened to replace the print head 8, and processing for moving the print head 8 to the head replacement position. In the state where the front door 22 is open, the ink tanks and the MTC can also be replaced. In a case where the head replacement preparation processing is performed, the ink replacement preparation operation and the MTC replacement preparation operation are therefore also performed. In the present exemplary embodiment, the preparation operations are performed in response to the pressing of the "unlock" button on the screen of FIG. 6D. The front door 22 is unlocked after the end of the replacement preparation operations. The screen of FIG. 6D therefore includes an area for making a notification that the front door 22 will not be unlocked during the time needed for the replacement preparation operations. The timing and condition to start the head replacement preparation processing are not limited to the foregoing. For example, the head replacement preparation processing may be started in response to the "yes" button on the screen of FIG. 6C being pressed by the user. For example, the head replacement preparation processing may be started in response to a user operation on the screen displayed before the screen of FIG. 6C is displayed.

As described above, in the present exemplary embodiment, the pressing of the unlock button by the user is needed to open the front door 22. Various preparation operations are then performed in response to the user operation related to unlocking being made. With such a configuration, for example, the preparation operations are prevented from being executed although the user does not open the front door 22 or do maintenance of the interior components of the printing apparatus 1.

In the foregoing description, the replacement of the ink tanks is described to be performed when an error related to the ink tanks occurs. However, this is not restrictive. The user may perform the replacement of the ink tanks at arbitrary timing when the user wants to replace the ink tanks, as with the foregoing head replacement. More specifically, the user may cause the display screen of FIG. 6B to be displayed on the printing apparatus 1 at arbitrary timing by operating the setting screen of the printing apparatus 1 displayed on the operation panel 104. The replacement of the print head 8 may be performed when an error related to the print head 8 occurs. In other words, the printing apparatus 1 may display the screen of FIG. 6C or 6D in response to the occurrence of an error related to the print head 8. An unlock screen for replacing the MTC may be displayed in a case where an error related to the MTC occurs or in a case where the user operates the setting screen of the printing apparatus 1 displayed on the operation panel 104 at arbitrary timing when the user wants to replace the MTC.

Both the MTC and the ink tanks need to be replaced, for example, if an error related to the MTC and an error related to the ink tanks occur at the same time, or during initialization. In such cases, the printing apparatus 1 displays the unlock screen for replacing the MTC and the unlock screen for replacing the ink tanks at different timings. Specifically, for example, the printing apparatus 1 initially displays the unlock screen for replacing the MTC to prompt the user to replace the MTC. When the MTC is replaced and the front door 22 is closed, the printing apparatus 1 locks the front door 22. The printing apparatus 1 then displays the unlock screen for replacing the ink tanks to prompt the user to replace the ink tanks. The replacement of the MTC is prompted first because the MTC collects the ink that flows during the replacement of the ink tanks. In a case where not only the MTC but the ink tanks are also replaced when the front door 22 is opened by using the unlock screen for replacing the MTC, then the printing apparatus 1 does not need to display the unlock screen for replacing the ink tanks.

If, after the head replacement preparation processing, the print head 8 is replaced and the front door 22 is locked, preparation processing for using the print head 8 is performed. Specifically, the inks are supplied from the ink tanks to the print head 8. For such preparation processing, the remaining ink levels of the inks supplied from the ink tanks and the remaining capacity level of the MTC to collect waste ink generated during the ink supply from the ink tanks are needed. The printing apparatus 1 may check the remaining levels of the inks stored in the ink tanks and the remaining capacity level of the MTC to store the waste ink before the head replacement preparation processing, and determine whether a low-level error occurs in any of the ink tanks and the MTC. If occurrence of a low-level error is detected, the unlock screen for replacing the ink tanks or the unlock screen for replacing the MTC may be displayed to replace the component(s) causing the error. The unlock screen for replacing the print head 8 is displayed after the ink tank(s) and/or the MTC is/are replaced and the ink tanks and the MTC are confirmed to be free of a low-level error.

The unlock screens may be displayed not only when an error occurs or when the setting screen is operated as described above, but also at other timing. For example, in the present exemplary embodiment, the unlock screens are displayed during initialization and in setting a transportation mode.

In the present exemplary embodiment, the unlock operations are made on software buttons displayed on the operation panel 104. However, this is not restrictive. For example, if the printing apparatus 1 includes a hardware button for accepting an unlock operation, the unlock operations may be made on the hardware button. In such a case, for example, operations on the hardware button may be disabled while the printing apparatus 1 is printing. The unlock operations may be any operations that are made on a component of the printing apparatus 1 other than the front door 22 and can be detected by the printing apparatus 1.

Figure 7:
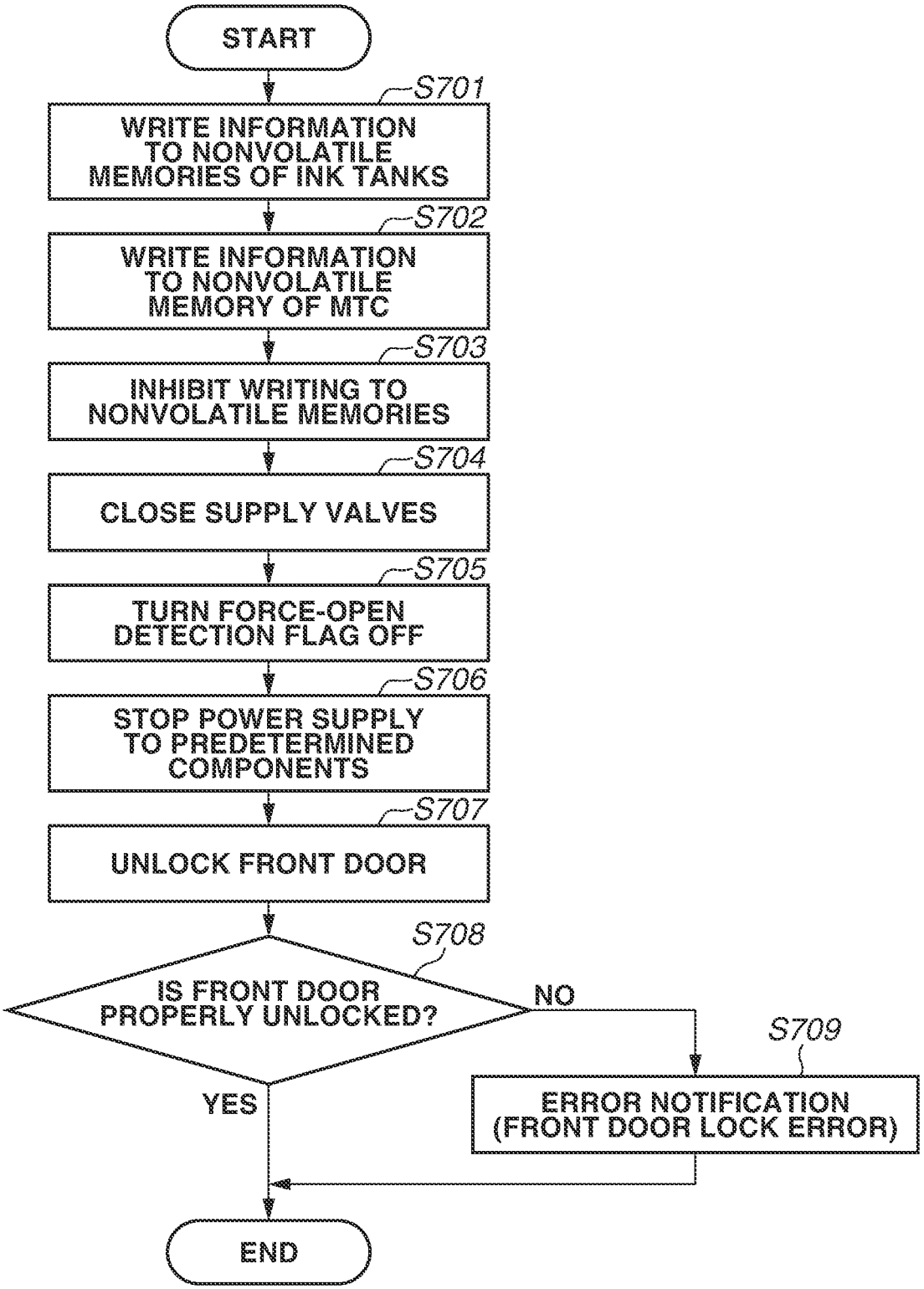
FIG. 7 is a flowchart illustrating processing for unlocking a front door to be performed by the printing apparatus.

FIG. 7 is a flowchart illustrating processing for unlocking the front door 22 to be performed by the printing apparatus 1. The processing illustrated in the present flowchart is started when the pressing of the unlock button on the unlock screen illustrated in FIG. 6B is accepted. The processing illustrated in the present flowchart is, in fact, implemented by the main controller 101 reading a program stored in a memory, such as the ROM 107, into the RAM 106 and executing the program.

In step S701, the printing apparatus 1 starts the ink replacement preparation processing. Specifically, the printing apparatus 1 initially writes the information related to the ink tanks to the nonvolatile memories included in the respective ink tanks.

In step S702, the printing apparatus 1 starts the MTC replacement preparation processing. Specifically, the printing apparatus 1 initially writes the information related to the MTC to the nonvolatile memory provided in the MTC.

In step S703, the printing apparatus 1 performs processing for inhibiting the writing of information to the nonvolatile memories provided in the ink tanks and the nonvolatile memory provided in the MTC. This is to suppress the occurrence of inconsistency in written data resulting from the user replacing the ink tanks or the MTC while information is being written to the nonvolatile memories.

In step S704, the printing apparatus 1 closes all the supply valves so that air will not get into the ink supply channels when the ink tanks are detached.

In step S705, to make the front door 22 openable, the printing apparatus 1 performs control so that force-open detection processing to be described below will not be performed. Specifically, the printing apparatus 1 turns off a force-open detection flag.

In step S706, the printing apparatus 1 stops power supply to predetermined components of the printing apparatus 1. Specific examples of the predetermined components include components related to the conveyance of a recording medium S (the components illustrated in FIG. 4) and components related to the maintenance operation (the wiping unit 17, the maintenance unit 16, and the cap unit 10). This can improve the user's safety since no print operation, conveyance operation, or maintenance operation is performed while the front door 22 is opened and the user is operating the interior of the printing apparatus 1.

In step S707, the printing apparatus 1 unlocks the front door 22. In other words, the printing apparatus 1 controls the front door 22 to be openable. Here, the printing apparatus 1 can unlock the front door 22 and also move the front door 22 to the open position automatically (without a user operation).

In step S708, after the unlocking processing of step S707, the printing apparatus 1 determines whether the front door 22 is properly unlocked. The reason is that although the unlocking processing of step S707 is performed, the front door 22 can fail to be properly unlocked due to a defect of a locking motor in charge of the locking function of the front door 22. If the determination is YES (YES in step S708), the processing ends. If the determination is NO (NO in step S708), the processing proceeds to step S709.

In step S709, the printing apparatus 1 notifies the user of the occurrence of an unlock error of the front door 22 (that the front door 22 fails to be properly unlocked and the front door 22 is not in an openable state). Specifically, the printing apparatus 1 displays a screen for making a notification of the occurrence of the unlock error of the front door 22 on the operation panel 104. The printing apparatus 1 then ends the processing.

If the pressing of the unlock button is accepted on the unlock screen illustrated in FIG. 6D, the head replacement preparation processing is started, for example, before step S701. The head replacement preparation processing is desirably performed after the MTC replacement preparation processing. The reason is that the head replacement preparation processing can use the MTC in performing processing for discharging the ink remaining in the print head 8. The head replacement preparation processing is unable to be completed if the amount of ink stored in the MTC exceeds an acceptable level. In step S703, the writing to the nonvolatile memory provided in the print head 8 is inhibited.

In the present exemplary embodiment, an error notification is described to be issued in step S709 if the determination in step S708 is NO even once. However, this is not restrictive. The printing apparatus 1 may repeat the determination of step S708 if the determination is NO. If the NO determination continues a plurality of times, then in step S709, the printing apparatus 1 may issue an error notification.

As described above, in the present exemplary embodiment, the printing apparatus 1 executes various preparation operations in response to an unlock operation being made by the user. With such a configuration, the printing apparatus 1 can suppress needless execution of the preparation operations, compared to a configuration in which the preparation operations are automatically executed without requiring the user's operation.

Figure 8:
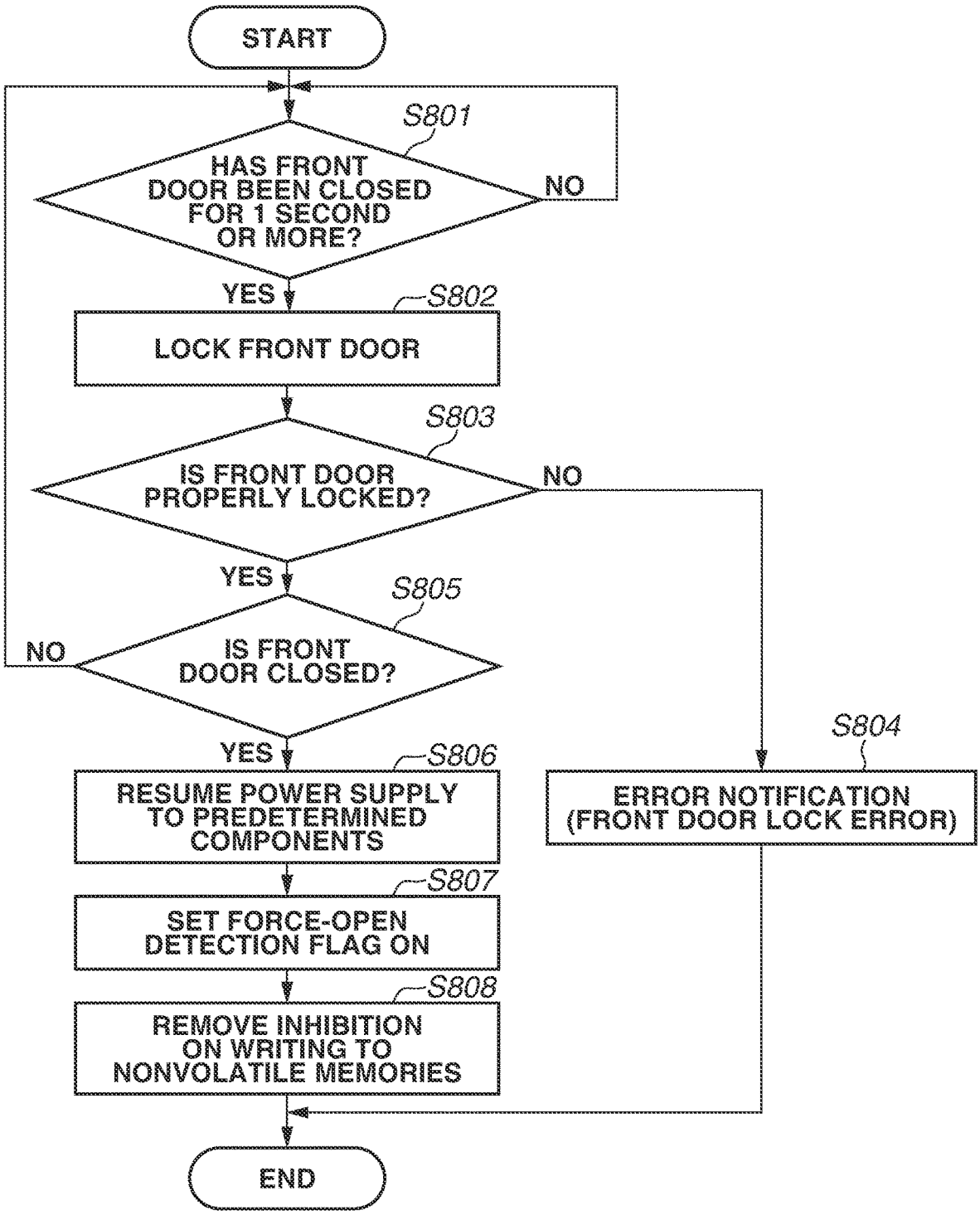
FIG. 8 is a flowchart illustrating processing for locking the front door to be performed by the printing apparatus.

FIG. 8 is a flowchart illustrating processing for locking the front door 22 to be performed by the printing apparatus 1. The processing illustrated in the present flowchart is started if the front door 22 is opened (moved to the open position) and then closed again (moved to the closed position). Specifically, the printing apparatus 1 includes a not-illustrated opening and closing sensor that can detect the opening and closing state of the front door 22. The processing illustrated in the present flowchart is started if the opening and closing sensor detects that the front door 22 is closed. The processing illustrated in the present flowchart is, in fact, implemented by the main controller 101 reading a program stored in a memory, such as the ROM 107, into the RAM 106 and executing the program.

In step S801, the printing apparatus 1 determines whether the front door 22 has been closed (has been located at the closed position) for a predetermined time (here, 1 sec) or more, based on an output obtained from the opening and closing sensor. If the determination is YES (YES in step S801), the processing proceeds to step S802. If the determination is NO (NO in step S801), the processing returns to step S801.

In step S802, the printing apparatus 1 locks the front door 22. In other words, the printing apparatus 1 performs control so that the front door 22 will not be opened by the user's manual operation on the front door 22.

In step S803, the printing apparatus 1 determines whether the front door 22 is properly locked. The reason is that although the locking processing of step S802 is performed, the front door 22 can fail to be properly locked due to a defect of the locking motor in charge of the locking function of the front door 22. If the determination is YES (YES in step S803), the processing proceeds to step S805. If the determination is NO (NO in step S803), the processing proceeds to step S804.

In step S804, the printing apparatus 1 notifies the user of the occurrence of a lock error of the front door 22 (that the front door 22 fails to be properly locked and the front door 22 is in an openable state). Specifically, the printing apparatus 1 displays a screen for making a notification of the occurrence of the lock error of the front door 22 on the operation panel 104. The printing apparatus 1 then ends the processing.

In step S805, the printing apparatus 1 determines whether the front door 22 is closed based on the output obtained from the opening and closing sensor. The reason is that the front door 22 can be opened by a user operation on the front door 22 during the processing of steps S801 to S803. If the determination is YES (YES in step S805), the processing proceeds to step S806. If the determination is NO (NO in step S805), the processing returns to step S801 after the front door 22 is detected to be closed again.

In step S806, the printing apparatus 1 resumes power supply to the predetermined components of the printing apparatus 1. Specific examples of the predetermined components include the components related to the conveyance of a recording medium S (the components illustrated in FIG. 4) and the components related to the maintenance operation (the wiping unit 17, the maintenance unit 16, and the cap unit 10). The printing apparatus 1 thus becomes capable of the print operation, conveyance operation, and maintenance operation again. If, for example, there is a door to be unlocked by an unlock operation other than the front door 22, the printing apparatus 1 may also detect whether the door is locked. The power supply may be resumed if all such doors are locked.

In step S807, the printing apparatus 1 performs control so that the force-open detection processing to be described below is performed. Specifically, the printing apparatus 1 sets the force-open detection flag on.

In step S808, the printing apparatus 1 performs processing for removing the inhibition on the writing of information to the nonvolatile memories provided in the ink tanks (permits writing) and the nonvolatile memory provided in the MTC. The processing ends.

Subsequently, the printing apparatus 1 may determine whether the ink tanks, the MTC, and the print head 8 are properly mounted on the printing apparatus 1, and whether an error is solved. If such determinations are NO, the printing apparatus 1 may display an unlock screen again.

Figure 16:
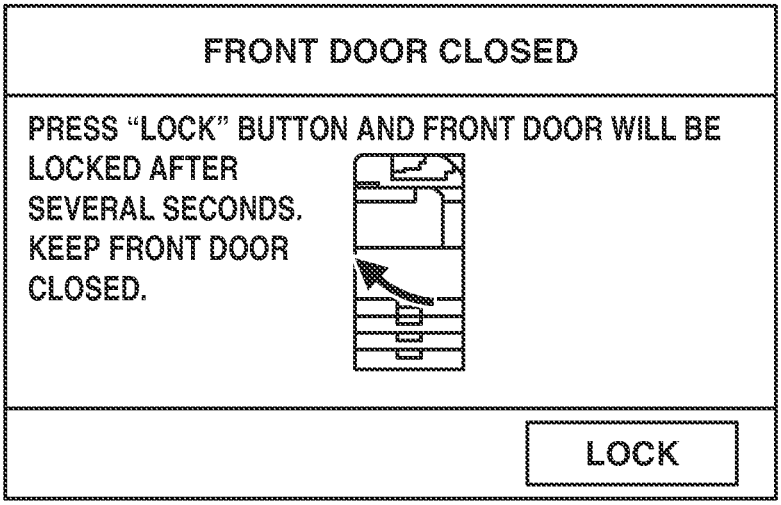
FIG. 16 is a diagram illustrating a lock screen.

In the foregoing description, the printing apparatus 1 is described to automatically lock the front door 22 in step S802. However, this is not restrictive. For example, the printing apparatus 1 may display a lock screen illustrated in FIG. 16 in step S802, and lock the front door 22 if a lock operation on the lock screen is made by the user. The reason is that although the front door 22 is closed, the user can open the front door 22 again and do maintenance.

<Transportation Preparation Processing>

In the present exemplary embodiment, the printing apparatus 1 performs transportation preparation processing based on user instructions before transportation of the printing apparatus 1. The transportation preparation processing refers to processing for preparing against vibrations during the transportation of the printing apparatus 1.

Figure 9:
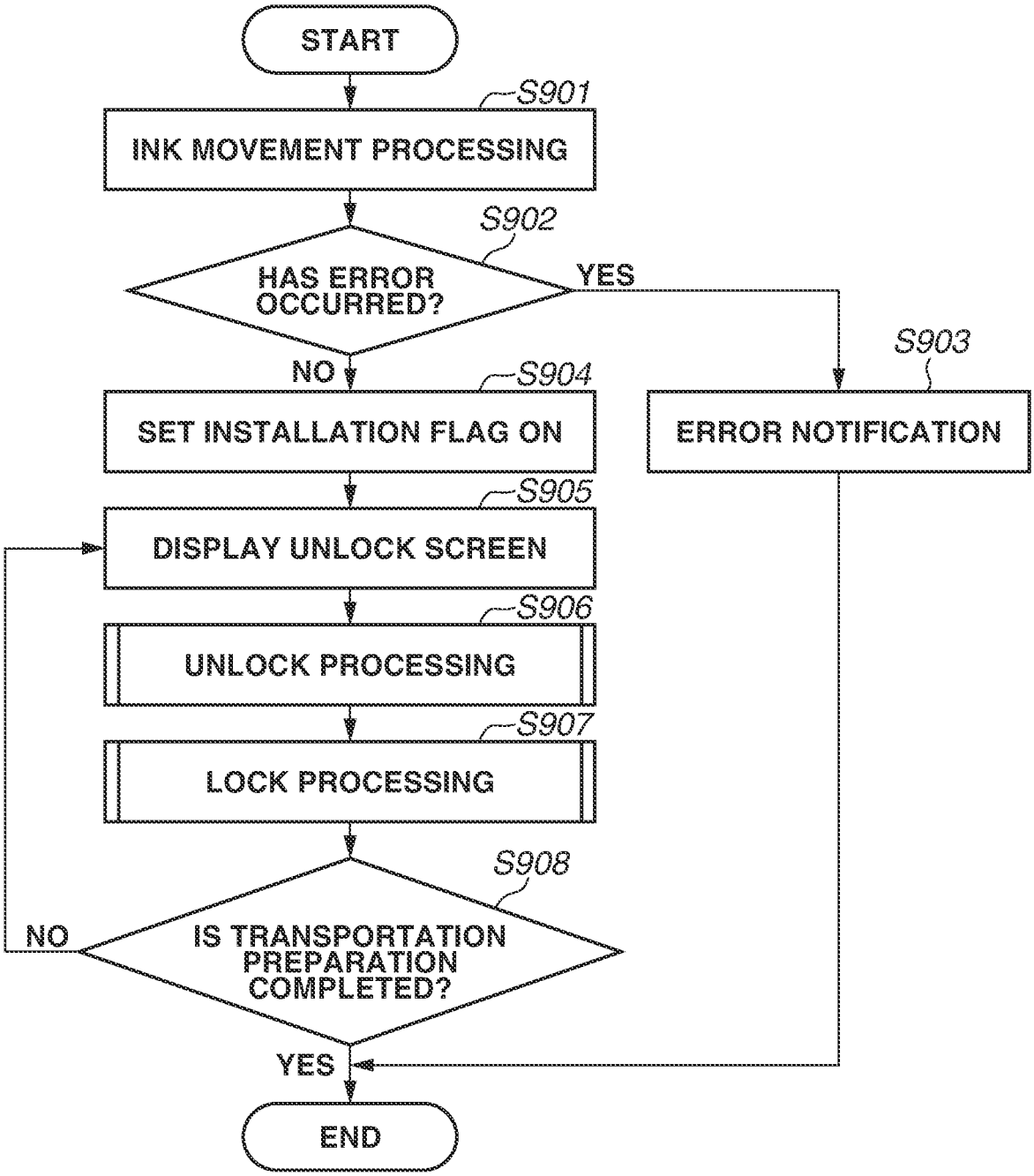
FIG. 9 is a flowchart illustrating transportation preparation processing to be performed by the printing apparatus.

FIG. 9 is a flowchart illustrating the transportation preparation processing performed by the printing apparatus 1. The processing illustrated in the present flowchart is started when user operations for transportation preparation are made on a not-illustrated menu screen.

In step S901, the printing apparatus 1 moves the ink remaining in the print head 8 and in the ink supply channels leading to the print head 8 to the sub tank or the MTC (ink movement processing). The user operations for transportation preparation may include an operation for setting a transportation level. The transportation level indicates a setting about whether the transportation that the user is going to conduct is such that the printing apparatus 1 will be unused for a long period of time or such that the printing apparatus 1 will be unused for a short period of time. The former setting will be referred to as a long-term setting, and the latter a short-term setting. Different processes may be performed to move the ink in step S901 based on the setting of the transportation level. Specifically, if the transportation level indicates the long-term setting, the printing apparatus 1 may move all the ink remaining in the print head 8 and the ink supply channels leading to the print head 8 to the sub tank or the MTC. If the transportation level indicates the short-time setting, the printing apparatus 1 may move some of the ink remaining in the print head 8 and the ink supply channels leading to the print head 8 to the sub tank or the MTC.

In step S902, the printing apparatus 1 determines whether an error has occurred in the ink movement processing of step S901. If the configuration for moving the ink is defective, an error that the ink remaining in the print head 8 and the ink supply channels leading to the print head 8 is unable to be normally moved to the sub tank or the MTC can occur. Specifically, for example, an error occurs if the amount of ink in the sub tank or the MTC exceeds an acceptable level. If the determination is YES (YES in step S902), the processing proceeds to step S903. If the determination is NO (NO in step S902), the processing proceeds to step S904.

In step S903, the printing apparatus 1 notifies the user of the occurrence of the error in the ink movement processing.

Specifically, for example, the printing apparatus 1 displays a screen for making a notification of the occurrence of the error in the ink movement processing on the operation panel 104. The printing apparatus 1 then ends the processing without setting on an installation flag to be described below. To solve the error, the printing apparatus 1 here may display an unlock screen to have the user solve the error.

Figure 15:
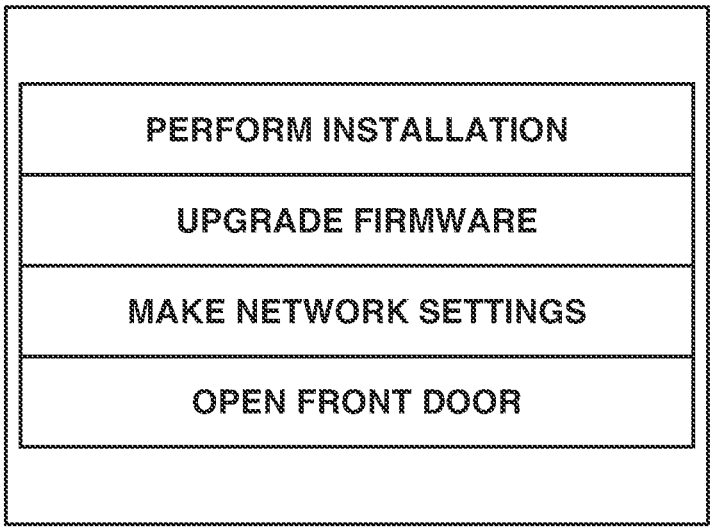
FIG. 15 is a diagram illustrating an initialization screen.

In step S904, the printing apparatus 1 sets the installation flag on. The installation flag is a flag to be referred to by the printing apparatus 1 when the printing apparatus 1 is powered on. If the installation flag referred to upon power-on is on, the printing apparatus 1 displays an initialization screen of FIG. 15 to be described below and performs installation processing. On the other hand, if the installation flag referred to upon power-on is off, the printing apparatus 1 moves the ink back to the print head 8 and the ink supply channels, and returns to a printable state without performing the installation processing.

In step S905, the printing apparatus 1 displays an unlock screen and accepts an unlock operation from the user.

In step S906, the printing apparatus 1 performs the unlock processing illustrated in FIG. 7. If the front door 22 is unlocked in step S906, the user detaches the ink tanks, the MTC, and the print head 8, and attaches a carriage fixing member for preventing movement of a carriage to which the print head 8 is attached. If an unlock operation is accepted, the printing apparatus 1 moves the carriage and the print head 8 attached to the carriage to a predetermined position for attaching the carriage fixing member, and then unlocks the front door 22. The printing apparatus 1 then detects the closing of the front door 22 by the user.

In step S907, the printing apparatus 1 performs the lock processing illustrated in FIG. 8.

In step S908, the printing apparatus 1 determines whether the transportation preparation is completed. Specifically, the printing apparatus 1 determines whether the detachment of the ink tanks, the MTC, and the print head 8, and the attachment of the carriage fixing member for preventing movement of the carriage to which the print head 8 is attached are completed. If the determination is YES (YES in step S908), the processing ends. If the determination is NO (NO in step S908), the processing returns to step S905.

As described above, when powered on, the printing apparatus 1 refers to the installation flag to see whether the installation flag is on or off. If the printing apparatus 1 is powered on for the first time after the completion of the transportation preparation processing illustrated in FIG. 9, the installation flag is on. With the installation flag on, the ink tanks, the MTC, and the print head 8 are detached from the printing apparatus 1, and the carriage fixing member for preventing movement of the carriage to which the print head 8 is attached is attached to the printing apparatus 1. To use the functions of the printing apparatus 1, the user therefore needs to perform initialization of the printing apparatus 1 again. If the installation flag referred to is on, the printing apparatus 1 then displays the initialization screen illustrated in FIG. 15.

The initialization screen includes an area for performing installation (initialization), an area for upgrading the firmware of the printing apparatus 1, an area for making network settings of the printing apparatus 1, and an area for unlocking the front door 22. If the area for unlocking the front door 22 is operated, the printing apparatus 1 displays an unlock screen. For example, the printing apparatus 1 can be powered off during the preparation processing illustrated in FIG. 9 (in a state where the detachment of the ink tanks, the MTC, and the print head 8 and the attachment of the carriage fixing member are not completed). In such a case, after the printing apparatus 1 is powered on, the user can press the area for unlocking the front door 22, open the front door 22, and perform the rest of the foregoing preparation processing.

If the area for performing installation (initialization) is pressed by the user, the printing apparatus 1 displays an unlock screen. Accepting an unlock operation from the user, the printing apparatus 1 displays an instruction screen for prompting attachment of the ink tanks, the MTC, and the print head 8 and the detachment of the carriage fixing member on the operation panel 104. The printing apparatus 1 then performs the unlock processing. The user opens the front door 22, and performs the attachment of the ink tank, the MTC, and the print head 8, and the detachment of the carriage fixing member according to the instruction screen. If the front door 22 is closed by the user and the lock processing illustrated in FIG. 8 is completed, the printing apparatus 1 determines whether the attachment of the ink tanks, the MTC, and the print head 8 and the detachment of the carriage fixing member are completed. If the attachment of the ink tanks, the MTC, and the print head 8 and the detachment of the carriage fixing member are not completed, the printing apparatus 1 displays the unlock screen again. The printing apparatus 1 here may instruct the user to perform the unfinished processing of the attachment of the ink tanks, MTC, and the print head 8 and the detachment of the carriage fixing member. On the other hand, if the attachment of the ink tanks, the MTC, and the print head 8 and the detachment of the carriage fixing member are completed, the printing apparatus 1 performs preparation processing for making the functions of the printing apparatus 1 usable. Examples of the preparation processing include filling ink into the print head 8. The printing apparatus 1 is thereby restored from the transportation state and becomes capable of performing various functions (such as printing, scan, and copy functions).

The initialization screen is also displayed, for example, if the printing apparatus 1 is activated for the first time after factory shipment.

<Warning Processing (Notification Processing) During Locking>

As described above, the printing apparatus 1 locks the front door 22 and prevents the front door 22 from being opened by the user's manual operation on the front door 22 until the front door 22 is unlocked by an unlock operation.

Figure 11:
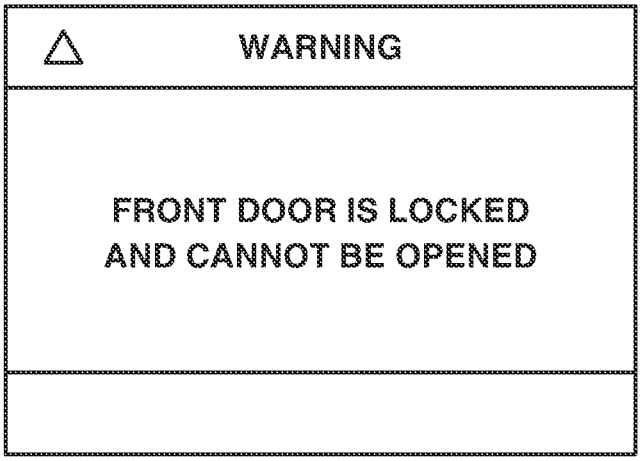
FIG. 11 is a diagram illustrating a warning screen.

However, if the user is unaware that the front door 22 is locked, the user can make an operation to open the front door 22 (opening operation) on the front door 22 (make a force-open operation) despite the front door 22 being locked. If the force-open operation continues, the front door 22 can be broken. In the present exemplary embodiment, the printing apparatus 1 performs force-open detection processing for detecting whether a force-open operation is made. If a force-open operation is detected to be made, the printing apparatus 1 performs processing for warning the user that the front door 22 is locked. Specifically, if a force-open operation is made, the printing apparatus 1 issues warning sound (notification sound) from a not-illustrated speaker. The printing apparatus 1 also displays a warning screen illustrated in FIG. 11 on the operation panel 104. The warning screen is intended to make a notification that the front door 22 is locked, and dissuade the user from making an opening operation. The printing apparatus 1 may then display an unlock screen on the operation panel 104. The printing apparatus 1 may display a screen for prompting the user to open the front door 22 by using an unlock screen on the operation panel 104.

In the present exemplary embodiment, the printing apparatus 1 uses different warning methods depending on the state of the printing apparatus 1.

Figure 10:
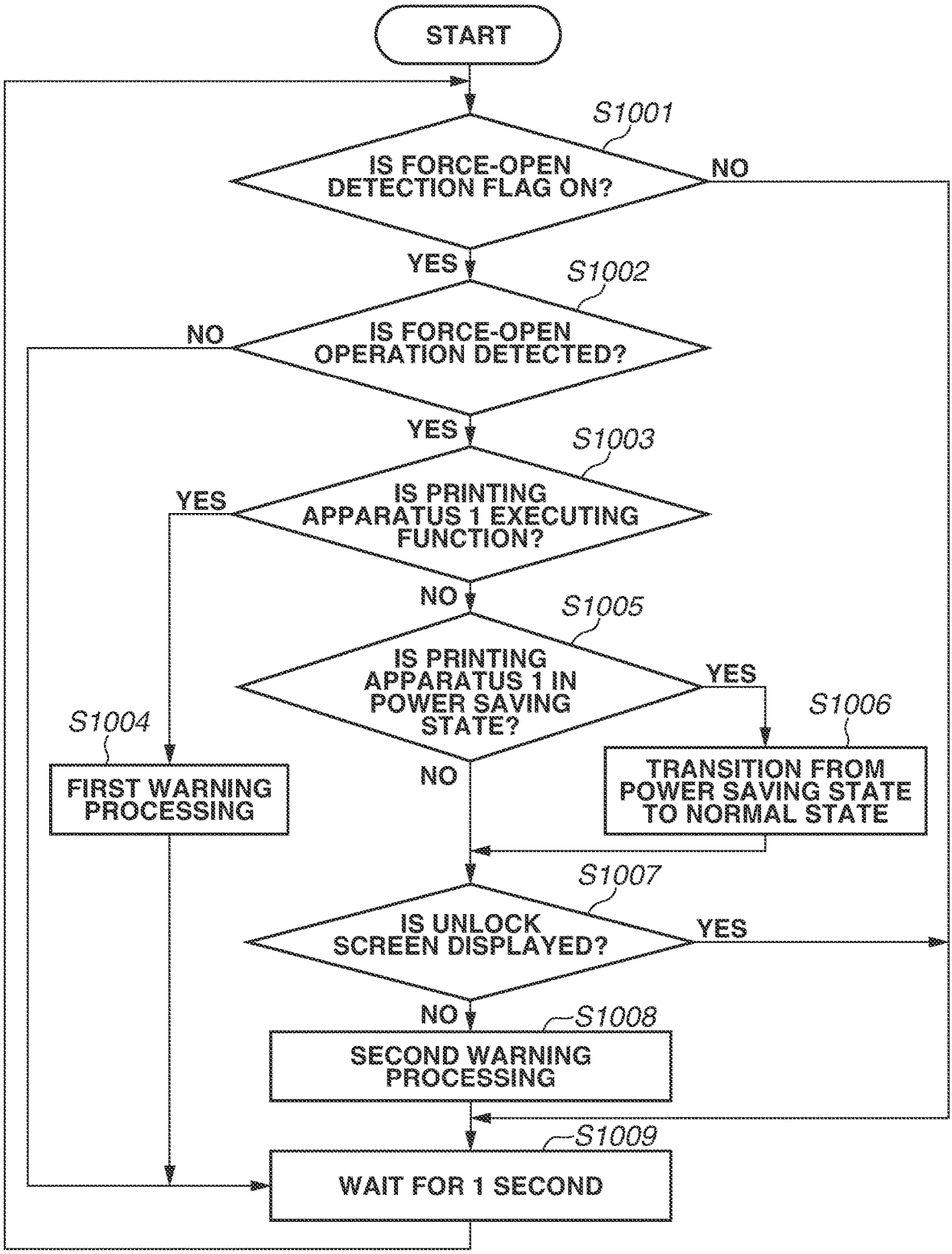
FIG. 10 is a flowchart illustrating force-open detection processing to be performed by the printing apparatus.

FIG. 10 is a flowchart illustrating the force-open detection processing performed by the printing apparatus 1. The processing illustrated in the present flowchart is started when the front door 22 is locked or when the printing apparatus 1 is powered on with the front door 22 locked. The processing illustrated in the present flowchart is implemented by the main controller 101 reading a program stored in a memory, such as the ROM 107, into the RAM 106 and executing the program.

In step S1001, the printing apparatus 1 determines whether the force-open detection processing is controlled to be executed. Specifically, the printing apparatus 1 determines whether the force-open detection flag is on. If the determination is YES (YES in step S1001), the processing proceeds to step S1002. If the determination is NO (NO in step S1001), the processing proceeds to step S1009.

In step S1002, the printing apparatus 1 determines whether an opening operation is made on the front door 22 by the user despite the locking of the front door 22 (whether a force-open operation is made). The printing apparatus 1 includes a detection sensor for detecting that an opening and closing knob provided on the front door 22 is held. The printing apparatus 1 determines whether a force-open operation is made based on an output obtained from the detection sensor. The printing apparatus 1 may make the determination, for example, by detecting a slight opening of the front door 22 by using the foregoing opening and closing sensor. If the determination is YES (YES in step S1002), the processing proceeds to step S1003. If the determination is NO (NO in step S1002), the processing proceeds to step S1009.

In step S1003, the printing apparatus 1 determines whether the printing apparatus 1 is executing a function. Examples of the function to be determined here include the print function, the scan function, the copy function, and the maintenance function. If the determination is YES (YES in step S1003), the processing proceeds to step S1004. If the determination is NO (NO in step S1003), the processing proceeds to step S1005.

Figure 12:
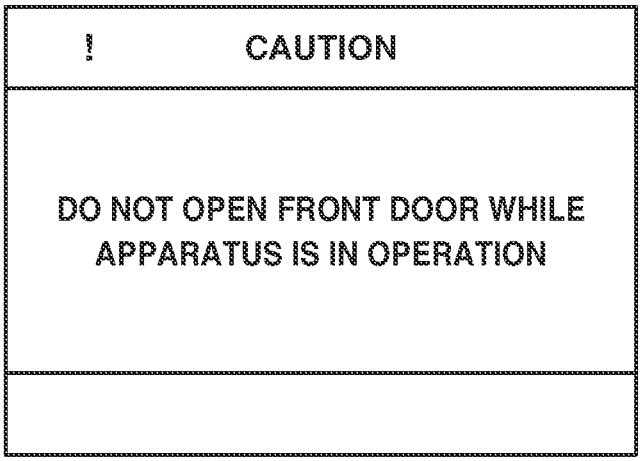
FIG. 12 is a diagram illustrating a warning screen.

In step S1004, the printing apparatus 1 performs first warning processing. The first warning processing includes processing for issuing warning sound at a volume higher than that of warning sound issued during second warning processing to be described below, and processing for displaying a warning screen for making a notification that the front door 22 is locked and prompting the user to quit the force-open operation on the operation panel 104. The first warning processing may include processing for issuing warning sound for a longer time than the duration of the warning sound during the second warning processing to be described below. The warning screen displayed in the first warning processing may be different from one displayed in the second warning processing. For example, in the first warning processing, a warning screen illustrated in FIG. 12 may be displayed to warn the user against making the force-open operation while the function is being executed. In the second warning processing, the warning screen illustrated in FIG. 11 may be displayed. The warning screens may be automatically hidden after a lapse of a predetermined time (for example, 2 seconds). The warning screens may be hidden in response to a user operation for closing a warning screen. The warning screens may be displayed only when a force-open operation is being detected by the detection sensor. The same applies to the stop timing of the warning sounds.

In step S1005, the printing apparatus 1 determines whether the printing apparatus 1 is in a power saving state (standby state). The power saving state is a state in which power supply to at least part of the components of the printing apparatus 1 is stopped or reduced so that power consumption is lower than in a normal state capable of various functions (print, scan, and copy functions). In the present exemplary embodiment, the power saving state refers to a state in which the power supply to the operation panel 104 is stopped, no screen is displayed on the operation panel 104, and various functions are not performed. If the determination is YES (YES in step S1005), the processing proceeds to step S1006. If the determination is NO (NO in step S1005), the processing proceeds to step S1007.

In step S1006, the printing apparatus 1 transitions from the power saving state to the normal state. In other words, the printing apparatus 1 resumes power supply to the components to which the power supply has been stopped. This enables the printing apparatus 1 to display a screen on the operation panel 104 and issue a warning sound.

In step S1007, the printing apparatus 1 determines whether an unlock screen is displayed. If the determination is YES (YES in step S1007), the processing proceeds to step S1009. If the determination is NO (NO in step S1007), the processing proceeds to step S1008. In making the determination, the printing apparatus 1 may further determine, for example, whether an error notification screen such as illustrated in FIG. 6A is displayed and whether a replacement screen such as illustrated in FIG. 6C is displayed.

In step S1008, the printing apparatus 1 performs the second warning processing. The second warning processing includes processing for issuing a warning sound at a volume lower than that of the warning sound issued during the first warning processing, and processing for displaying a warning screen for making a notification that the front door 22 is locked and prompting the user to quit the force-open operation on the operation panel 104. In the second warning processing, for example, either the processing for issuing the warning sound or the processing for displaying the warning screen may be omitted.

In step S1009, the printing apparatus 1 waits for a predetermined time (here, 1 second). The processing returns to step S1001.

The present flowchart is ended if the front door 22 is unlocked by an unlock operation.

As described above, if a force-open operation is detected, damage to the printing apparatus 1 by the force-open operation can be suppressed by warning the user.

Figure 13:
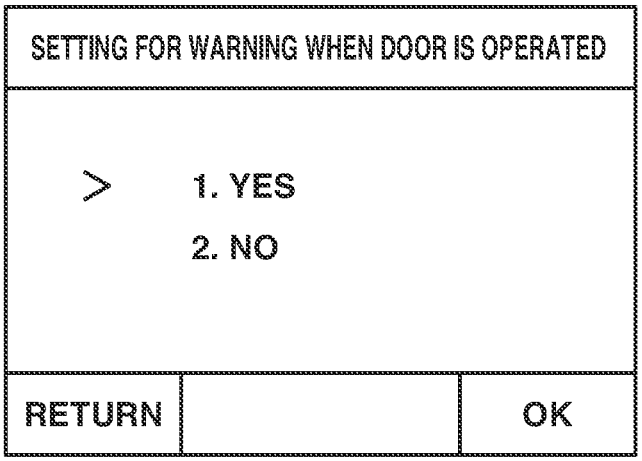
FIG. 13 is a diagram illustrating a warning setting screen.

The printing apparatus 1 may be configured, for example, so that whether to perform the warning processing can be set. For example, the printing apparatus 1 accepts an operation on a setting screen from the user and displays a warning setting screen such as illustrated in FIG. 13. On the warning setting screen, the user can make a setting whether to perform the warning processing. If a setting to perform the warning processing is made by the user, the warning processing illustrated in FIG. 10 is performed after the front door 22 is closed. On the other hand, if a setting to not perform the warning processing is made, the warning processing illustrated in FIG. 10 is not performed after the front door 22 is closed. That is, no warning screen is displayed and no warning sound is issued if an opening operation is made on the front door 22 despite the front door 22 being locked.

Figure 14:
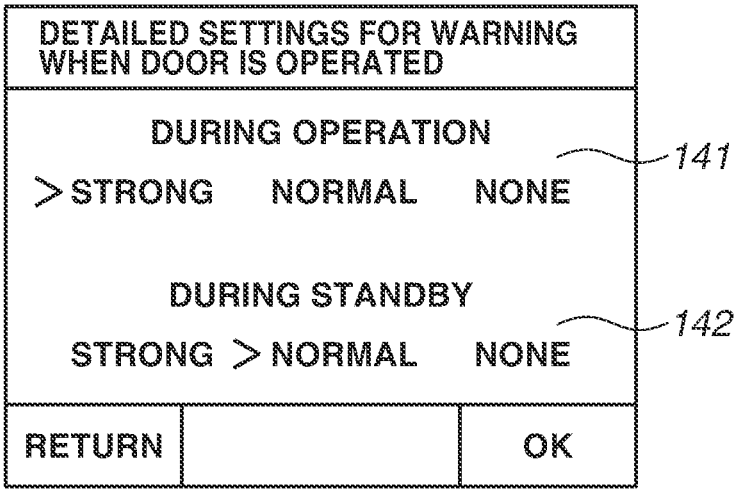
FIG. 14 is a diagram illustrating a selection screen.

The printing apparatus 1 may be configured, for example, so that which is performed, the first warning processing or the second warning processing, in a case where the determination in step S1003 is YES or in a case where the determination in step S1005 is YES can be set. For example, the printing apparatus 1 accepts an operation on the setting screen from the user and displays a selection screen such as illustrated in FIG. 14. An area 141 in the upper part of the screen is an area for setting which warning processing is performed if the determination in step S1003 is YES. An area 142 in the lower part of the screen is an area for setting which warning processing is performed if the determination in step S1005 is YES. If "strong" is selected, the first warning processing is set to be performed. If "normal" is selected, the second warning processing is set to be performed. If "none" is selected, neither of the first warning processing and the second warning processing is set to be performed. In other words, in the processing illustrated in FIG. 10, the first warning processing is set as the warning processing to be performed if the determination in step S1003 is YES, and the second warning processing is set as the warning processing to be performed if the determination in step S1005 is YES.

For example, if an additional force-open operation is detected while a warning screen is displayed or while a warning sound is issued, the display time of the warning screen being displayed or the issuance time of the warning sound being issued may or may not be extended. For example, if an additional force-open operation is detected while the second warning processing is performed, the first warning processing may be performed anew to raise the warning level.

For example, the second warning processing may be performed if a force-open operation continues for less than a predetermined time. The first warning processing may be performed if a force-open operation continues for the predetermined time or more.

In the foregoing description, the warning method is described to be switched based on the state of the printing apparatus 1 during a force-open operation. However, this is not restrictive. For example, only the second warning processing may be performed. For example, the determinations in steps S1003 and S1007 may be omitted.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like. While the present invention has been described with reference to exemplary embodiments, it is to be understood that the invention is not limited to the disclosed exemplary embodiments.

This application claims the benefit of Japanese Patent Application No. 2018-046013, filed Mar. 13, 2018, which is hereby incorporated by reference herein in its entirety.

What is claimed is:

1. A printing apparatus comprising:

a printing unit having a printing portion configured to perform printing;

a lock unit configured to lock an openable portion formed as part of a casing enclosing the printing portion, wherein the openable portion is configured to receive execution of a first user operation for opening the openable portion;

a display unit configured to display, on a display portion, a predetermined screen based on an occurrence of an error in at least part of the printing portion, wherein the predetermined screen is configured to receive performance of a second user operation for unlocking the openable portion, the first user operation is different from the second user operation;

a detection unit configured to detect that the second user operation for unlocking the openable portion is performed on the predetermined screen in a state where the openable portion is locked;

an execution unit configured to execute predetermined preparation processing on the printing portion; and an unlock unit configured to unlock the openable portion, wherein, in a case where the second user operation has been detected, the execution unit executes predetermined preparation processing on the printing portion, wherein, in a case where the second user operation performed on the predetermined screen has been detected, the unlock unit unlocks the openable portion after the predetermined preparation processing is executed, and wherein, even if the first user operation for opening the openable portion is executed on the openable portion in the state where the openable portion is locked, the openable portion is not opened and the predetermined preparation processing is not executed.

2. The printing apparatus according to claim 1, wherein the display unit is arranged to display the predetermined screen if an operation for replacing at least part of the printing portion is actuated.

3. The printing apparatus according to claim 1, wherein the printing portion includes a holding portion configured to hold a recording agent to be used for printing, and wherein the predetermined preparation processing includes processing for storing information about the recording agent into a memory provided in the holding portion.

4. The printing apparatus according to claim 1, wherein the printing portion includes a holding portion configured to hold a recording agent to be used for printing, and wherein the predetermined preparation processing includes processing for closing a supply valve configured to supply the recording agent from the holding portion.

5. The printing apparatus according to claim 1, wherein the printing portion includes a holding portion configured to hold a recording agent to be used for printing, and includes a collection portion configured to collect a recording agent unused for printing from out of the recording agent held in the holding portion, wherein, in a case where an error related to the holding portion and an error related to the collection portion occur, the display unit is arranged to display the predetermined screen and to display a first prompting screen for prompting a user to replace the collection portion, and wherein, in a case where the openable portion is opened in response to the first prompting screen and an accepting screen for accepting the second user operation being displayed on the display portion, and the opened openable portion is then locked, the display unit is arranged to display the predetermined screen and to display a second prompting screen for prompting the user to replace the holding portion.

6. The printing apparatus according to claim 5, wherein, in a case where the collection portion and the holding portion are replaced while the openable portion is opened in response to the predetermined screen and the first prompting screen for prompting the user to replace the collection portion being displayed on the display portion, the display unit is arranged to display the predetermined screen and not to display the second prompting screen for prompting the user to replace the holding portion.

7. The printing apparatus according to claim 1, wherein the printing portion includes a print head, and wherein the predetermined preparation processing includes processing for moving the print head to a replacement position for replacing the print head.

8. The printing apparatus according to claim 1, wherein the printing portion includes a print head, and wherein the predetermined preparation processing includes processing for opening a head cover configured to cover the print head.

9. The printing apparatus according to claim 1, wherein the printing portion includes a holding portion configured to hold a recording agent to be used for printing, and includes a print head, wherein, in a case where the second user operation is detected to be made in response to an error related to the holding portion occurring or a third user operation for replacing the holding portion being made, preparation processing related to the holding portion is executed and preparation processing related to the print head is not executed, and wherein, in a case where the second user operation is detected to be made in response to an error related to the print head occurring or a fourth user operation for replacing the print head being made, the predetermined preparation processing related to the holding portion and the predetermined preparation processing related to the print head are executed.

10. The printing apparatus according to claim 1, wherein the predetermined preparation processing includes processing for stopping power supply to at least part of the printing portion.

11. The printing apparatus according to a claim 1, further comprising a notification unit, wherein, in a case where the first user operation for opening the openable portion is made on the openable portion in the state where the openable portion is locked, the notification unit is arranged to perform predetermined notification processing.

12. The printing apparatus according to claim 11, wherein the predetermined notification processing includes processing for issuing a predetermined notification sound from a speaker.

13. The printing apparatus according to claim 11, wherein the predetermined notification processing includes processing for displaying a screen arranged to dissuade a user from making the first user operation for opening the openable portion on the openable portion.

14. The printing apparatus according to claim 11, further comprising a transition unit, wherein, in a case where the first user operation for opening the openable portion is made on the openable portion in a state where the openable portion is locked and the printing apparatus is in a second state in which power consumption is lower than in a first state, the transition unit is arranged to cause the printing apparatus to transition from the second state to the first state, and wherein, in a case where the first user operation for opening the openable portion is made on the openable portion in the state where the openable portion is locked and the printing apparatus is in the second state, the notification unit is arranged to perform the predetermined notification processing after the printing apparatus transitions from the second state to the first state.

15. The printing apparatus according to claim 1, wherein, in a case where the openable portion is opened and then the opened openable portion is closed, the lock unit is arranged to lock the openable portion.

16. The printing apparatus according to claim 1, wherein the printing portion is configured to perform printing by discharging ink onto a recording medium.

17. A method for controlling a printing apparatus, wherein the printing apparatus includes a printing unit having a printing portion configured to perform printing, and a lock unit configured to lock an openable portion formed as part of a casing enclosing the printing portion, wherein the openable portion is configured to receive execution of a first user operation for opening the openable portion, the method comprising:

displaying, on a display portion, a predetermined screen based on an occurrence of an error in at least part of the printing portion, wherein the predetermined screen is configured to receive performance of a second user operation for unlocking the openable portion, the first user operation is different from the second user operation;

detecting that the second user operation for unlocking the openable portion is performed on the predetermined screen in a state where the openable portion is locked; and executing predetermined preparation processing on the printing portion, wherein, in a case where the second user operation has been detected, executing includes executing predetermined preparation processing on the printing portion, wherein, in a case where the second user operation performed on the predetermined screen has been detected, executing includes unlocking the openable portion after the predetermined preparation processing is executed, and wherein, even if the first user operation for opening the openable portion is executed on the openable portion in the state where the openable portion is locked, the openable portion is not opened and the predetermined preparation processing is not executed.

18. A non-transitory computer-readable storage medium storing a program to cause a computer to perform a method for controlling a printing apparatus, wherein the printing apparatus includes a printing unit having a printing portion configured to perform printing, and a lock unit configured to lock an openable portion formed as part of a casing enclosing the printing portion, wherein the openable portion is configured to receive execution of a first user operation for opening the openable portion, the method comprising:

displaying, on a display portion, a predetermined screen based on an occurrence of an error in at least part of the printing portion, wherein the predetermined screen is configured to receive performance of a second user operation for unlocking the openable portion, the first user operation is different from the second user operation;

detecting that the second user operation for unlocking the openable portion is performed on the predetermined screen in a state where the openable portion is locked; and executing predetermined preparation processing on the printing portion, wherein, in a case where the second user operation has been detected, executing includes executing predetermined preparation processing on the printing portion, wherein, in a case where the second user operation performed on the predetermined screen has been detected, executing includes unlocking the openable portion after the predetermined preparation processing is executed, and wherein, even if the first user operation for opening the openable portion is executed on the openable portion in the state where the openable portion is locked, the openable portion is not opened and the predetermined preparation processing is not executed.

* * * * *